US011964181B2

(12) United States Patent
Johnson

(10) Patent No.: US 11,964,181 B2
(45) Date of Patent: Apr. 23, 2024

(54) UPPER BODY EXERCISE APPARATUS

(71) Applicant: Johnson Health Tech. Co., Ltd., Taichung (TW)

(72) Inventor: Noel Johnson, Stoughton, WI (US)

(73) Assignee: Johnson Health Tech Co., Ltd., Taichung (TW)

( * ) Notice: Subject to any disclaimer, the term of this patent is extended or adjusted under 35 U.S.C. 154(b) by 84 days.

(21) Appl. No.: 17/874,275

(22) Filed: Jul. 26, 2022

(65) Prior Publication Data

US 2024/0033563 A1 Feb. 1, 2024

(51) Int. Cl.
*A63B 22/00* (2006.01)

(52) U.S. Cl.
CPC ..... *A63B 22/0046* (2013.01); *A63B 22/0005* (2015.10); *A63B 2022/003* (2013.01); *A63B 2208/0204* (2013.01); *A63B 2208/0233* (2013.01); *A63B 2210/50* (2013.01)

(58) Field of Classification Search
CPC ..... A63B 22/0005; A63B 22/0046; A63B 2210/50
See application file for complete search history.

(56) References Cited

U.S. PATENT DOCUMENTS 5,643,150 A * 7/1997 Lee ..... A63B 21/068 482/76
6,071,215 A * 6/2000 Raffo ..... A63B 22/0076 72/142
7,841,969 B1 11/2010 Moran et al.
2002/0094915 A1* 7/2002 Lin ..... A63B 23/0429 482/53
2006/0217240 A1* 9/2006 White ..... A63B 21/068 482/95
2016/0346595 A1* 12/2016 Dalebout ..... A63B 22/0012

FOREIGN PATENT DOCUMENTS

CN 115006782 A * 9/2022
GB 2186498 A * 8/1987 ..... A63B 22/0076

* cited by examiner

*Primary Examiner* — Jennifer Robertson

(57) ABSTRACT

An upper body exercise apparatus for allowing a user to perform an upper body exercise includes a frame body, a physical exercise device mounted on the frame body, and a movable seat. The physical exercise device has at least one moving member for allowing the user to perform the upper body exercise. The movable seat has a seat post and a seat portion. The seat post has one end pivotally mounted on a base portion of the frame body about a pivot axis. The seat portion is mounted on the other end of the seat post. The movable seat is pivotable about the pivot axis between a use position where the user is able to perform the upper body exercise in a sitting position and an idle position where the user is able to perform the upper body exercise in a standing position.

11 Claims, 19 Drawing Sheets

UPPER BODY EXERCISE APPARATUS

BACKGROUND

1. Field of the Invention

The present invention relates to an exercise apparatus. More particularly, the present invention relates to an upper body exercise apparatus.

2. Description of the Related Art

U.S. Pat. No. 7,841,969 discloses an exercise apparatus (note: it has been commercialized, naming "Matrix Krankcycle") having a frame rested on the ground and an upper body exercise device mounted at an appropriate height of the frame. The upper body exercise device is provided for allowing a user's left and right hands respectively gripping the left hand pedal and the right hand pedal to perform an upper body exercise rotating about a transverse axis. The use can choose to perform the aforementioned upper body exercise in a sitting or standing position. If operating in the sitting position, a seat has to be installed onto the frame at a predetermined location, such that the seat is located behind the two hand pedals for supporting the user to perform the upper body exercise. If operating in the standing position, the seat has to be removed from the frame to allow the user to stand behind the upper body exercise device to perform the upper body exercise. In addition, the seat can be removed for allowing a user using a wheelchair to perform the aforementioned upper body exercise. In general, the aforementioned exercise apparatus can be changed between a first mode that requires the seat and a second mode that does not require the seat. However, if the user wants to change the exercise apparatus from the first mode to the second mode, it has to detach the seat from the frame, and if the user wants to change the exercise apparatus from the second mode to the first mode, the seat has to be reinstalled onto the frame. It is troublesome to change the exercise apparatus between the aforementioned two modes.

In another example, some exercise apparatus produced by SCIFIT (product name "StepOne Recumbent Stepper") allows users to sit on a seat assembly and use a physical exercise device to perform physical exercises of alternating hands and feet. The seat assembly can be pulled away from the exercise apparatus for allowing wheelchair users to perform the physical exercises, but it is also troublesome to move the seat assembly.

SUMMARY

The present invention provides an exercise apparatus for allowing a user to perform physical exercises between a first mode that the user can operate the exercise apparatus in a sitting position and a second mode that the user can operate the exercise apparatus in a standing position. Specifically, the seat of the exercise apparatus has no need to be detached from the exercise apparatus.

According to one aspect of the present invention, an exercise apparatus provided for allowing a user to perform a physical exercise includes a frame body having a base portion, a physical exercise device mounted on the frame body, and a movable seat. The exercise apparatus defines a longitudinal direction, a lateral direction and a vertical direction. The physical exercise device has at least one moving member for allowing the user to perform the physical exercise with hands or legs. The movable seat having a seat post and a seat portion. The seat post has a first end and the second end which is located higher than the first end. The first end of the seat post is pivotally mounted on the base portion of the frame body about a pivot axis. The seat portion is mounted on the second end of the seat post. The movable seat is pivotable about the pivot axis between a use position and an idle position. When the movable seat is in the use position, the seat portion is located above and behind the first end of the seat post and located behind the moving member. When the movable seat is in the idle position, the seat portion is located above and in front of the first end of the seat post and located at a left side or right side of the physical exercise device.

Under this arrangement, the exercise apparatus can be changed between the first mode and the second mode. When the exercise apparatus is in the first mode, the movable seat is in the use position for allowing the user to sit on the seat portion to perform the physical exercise. When the exercise apparatus is in the second mode, the movable seat is in the idle position for allowing the user to stand on the base portion to perform the physical exercise (especially the upper body exercise), and/or allowing wheelchair users to perform the physical exercise in the same area. When the exercise apparatus is in the second mode, the movable seat is moved to the idle position. It has no need to detach the movable seat from the exercise apparatus so as to save space. Therefore, the user can simply move the movable seat between the use position and the idle position for changing the usage mode of the exercise apparatus easily and quickly.

Preferably, the pivot axis is located in a horizontal plane, and an included angle between the pivot axis and the lateral direction ranges between 15 degrees to 75 degrees.

Preferably, the movable seat is rotatable between the use position and the idle position, and a rotation angle between the use position and the idle position is less than 90 degrees.

Preferably, the base portion of the frame body has an abutting portion located above and behind the first end of the seat post; the seat post has an inclined section adjacent to the first end. When the movable seat is in the use position, the inclined section of the seat post extends rearward and upward from the first end, and a rear side of the inclined section abuts against the abutting portion.

Preferably, the base portion of the frame body has a resting portion diagonally in front of and located above the first end. When the movable seat is in the idle position, the inclined section of the seat post extends obliquely forward and upward from the first end, and a front side of the inclined section abuts against the resting portion.

Preferably, a locking mechanism is arranged between the movable seat and the base portion of the frame body. The locking mechanism is operable to be changed between a locking state and a releasing state. When the locking mechanism is in the locking state, the movable seat can be locked in the use position to prevent the movable seat from rotating toward the idle position, or locked in the idle position to prevent the movable seat from rotating toward the use position.

Preferably, the locking mechanism has a first retaining member and a second retaining member respectively disposed at two predetermined positions at the base portion of the frame body close to the first end of the seat post. When the movable seat is in the use position and the lock bolt is in the lock position, the lock bolt is retained by the first retaining member so that the movable seat cannot be rotated toward the idle position. When the movable seat is in the idle position and the lock bolt is in the lock position, the lock bolt is retained by the second retaining member so that the movable seat cannot be rotated toward the use position.

Preferably, the moving member of the physical exercise device is provided for being operated by the user's hands. The physical exercise device is adjustable with respect to the frame body between a first position which is suitable for being operated in a sitting position and a second position which is suitable for being operated in a standing position. A height of the moving member when the physical exercise device is located at the second position is higher than a height of the moving member when the physical exercise device is located at the first position. The movable seat is rotatable freely between the use position and the idle position at least when the physical exercise device is located in the second position which is suitable for being operated in the standing position.

Preferably, when the physical exercise device is in the second position and the movable seat is in the idle position, an uppermost portion of the movable seat is located higher than a lowermost portion of the physical exercise device.

Preferably, the base portion of the frame body forms a standing area behind the first end of the seat post for allowing the user who takes a standing position to perform the physical exercise to stand thereon with two feet. When the movable seat is in the use position, the seat portion is located above the standing area.

Further benefits and advantages of the present invention will become apparent after a careful reading of the detailed description with appropriate reference to the accompanying drawings.

DETAIL DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically depicted in order to simplify the drawings.

Figure 1:
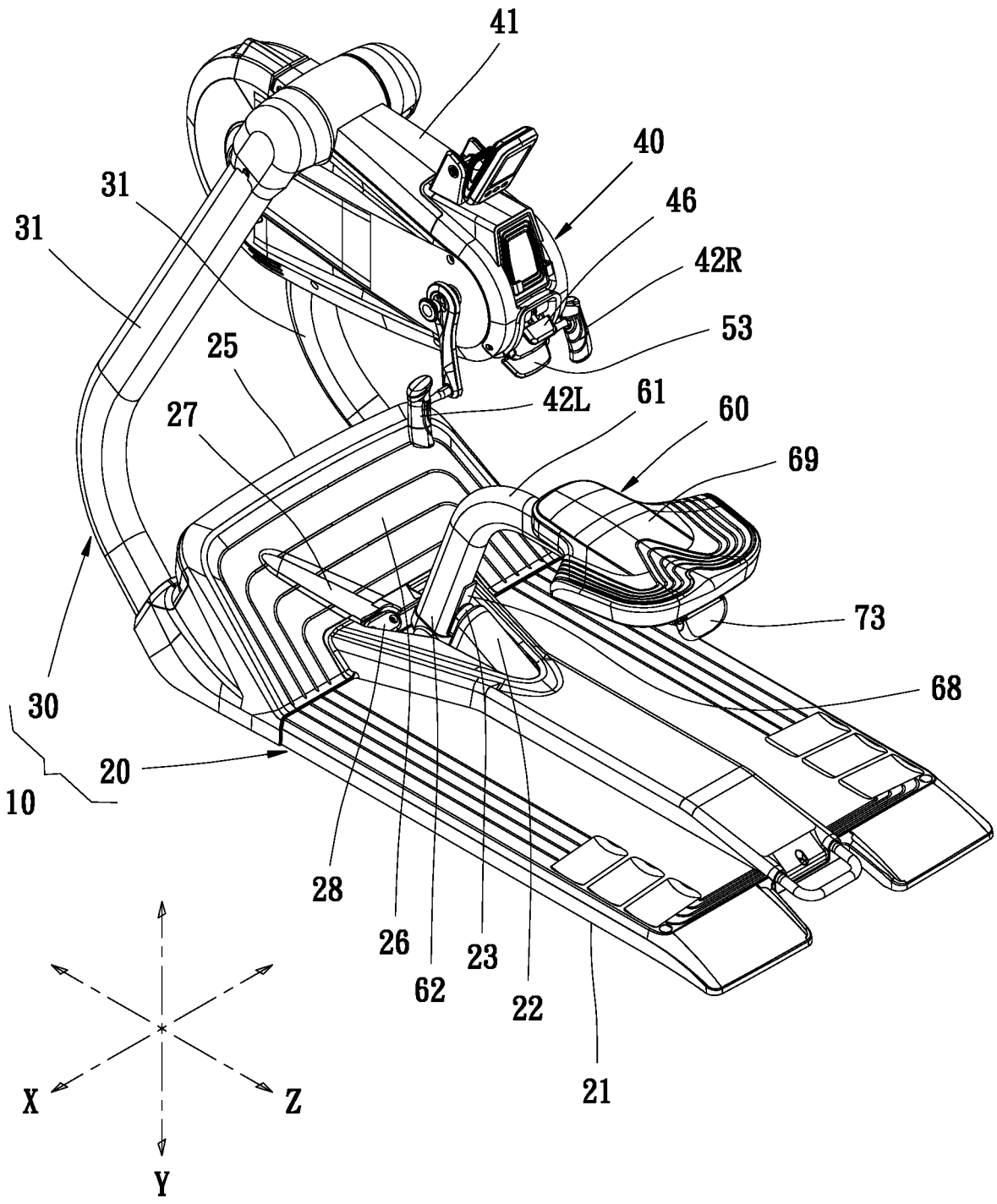
FIG. 1 is a perspective view of an upper body exercise apparatus in accordance with a preferred embodiment of the present invention.
Figure 2:
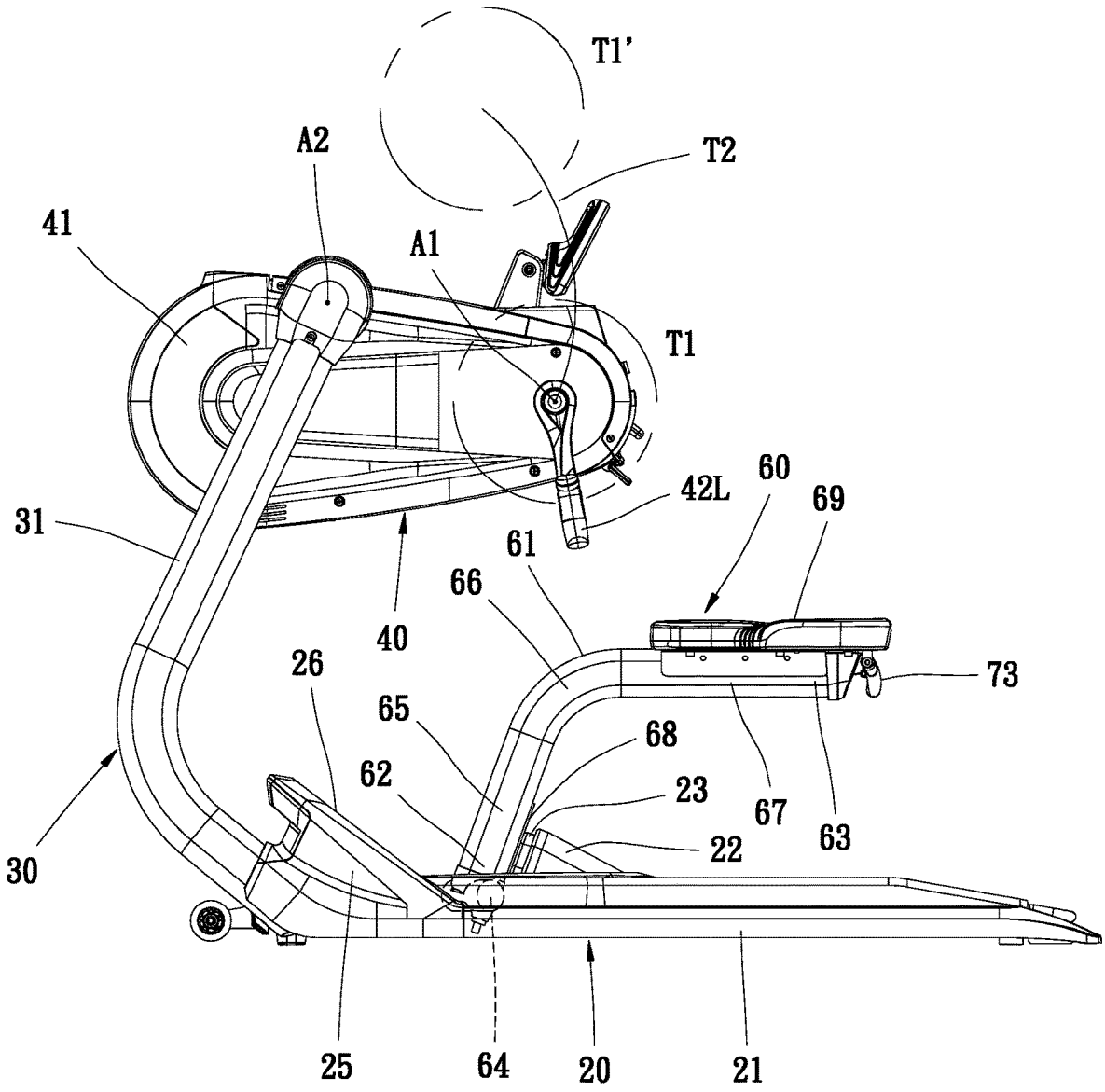
FIG. 2 is a side view of the upper body exercise apparatus shown in FIG. 1.
Figure 3:
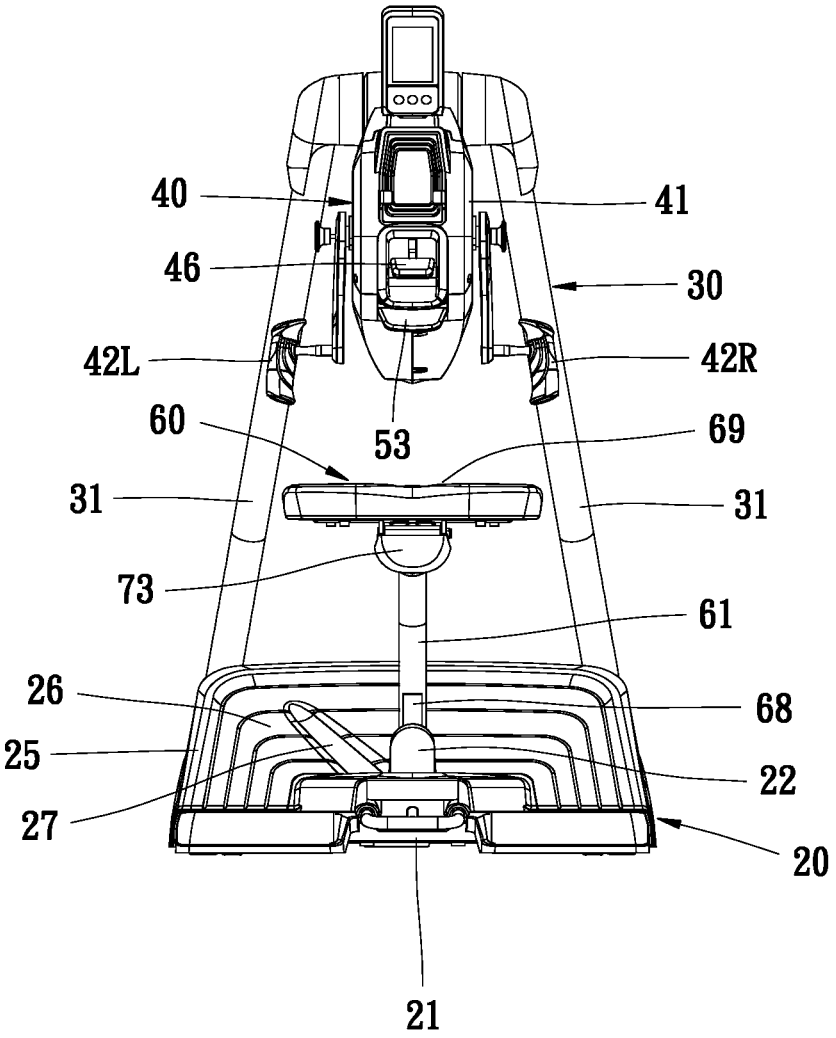
FIG. 3 is a rear view of the upper body exercise apparatus shown in FIG. 1.

Referring to FIG. 1 to FIG. 3, an upper body exercise apparatus is illustrated in accordance with a preferred embodiment of the present invention. The exercise apparatus has a frame body 10 rested on the ground and a physical exercise device 40 mounted at an appropriate height of the frame body 10 for allowing a user to perform an upper body exercise. The user can choose to perform the aforementioned upper body exercise in a predetermined sitting or standing position, and the user is in the same location and facing the same direction whether sitting or standing. When the user performs the aforementioned upper body exercise, the direction that the user faces and the direction that the user's back faces respectively correspond to the front and rear of the exercise apparatus. In other words, the front-rear direction, the left-right direction, and the up-down direction of the user's body when performing the aforementioned upper body exercise respectively define the longitudinal direction Z, the lateral direction X and the vertical direction Y of the exercise apparatus. The aforementioned exercise apparatus is substantially symmetrical in appearance.

Figure 11:
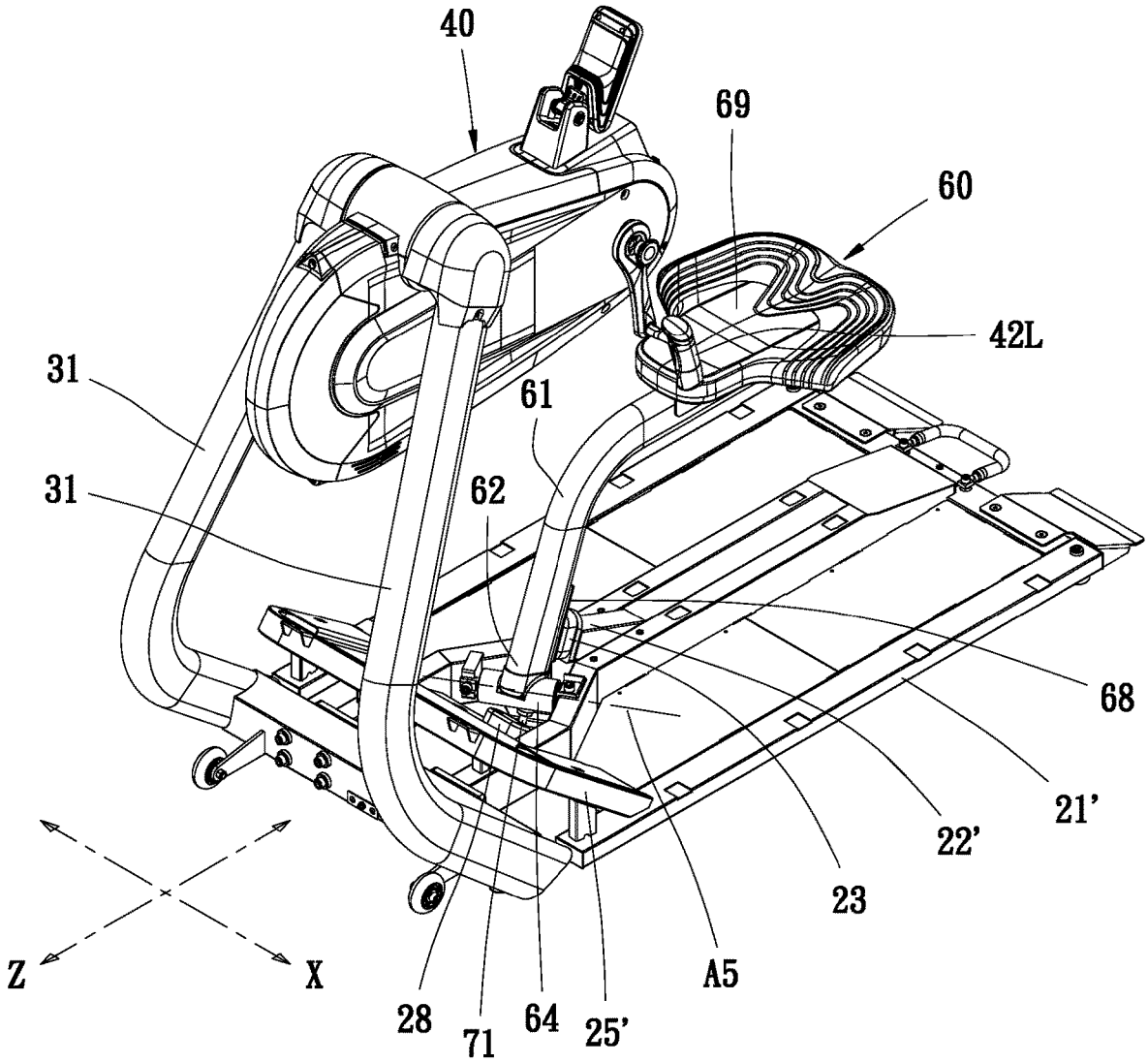
FIG. 11 is a perspective view of the upper body exercise apparatus without plastic shells of a chassis.

The frame body 10 has a base portion 20 rested on the ground and an upright portion 30 extending upward from the base portion 20. The base portion 20 has a chassis 21 with a shape similar to a rectangular plate and an inclined platform 25 fixed on the front end of the chassis 21. The chassis 21 and the incline platform 25 shown in FIG. 1 to FIG. 3 are all covered with plastic shells, and FIG. 11 shows them without the plastic shells. In the preferred embodiment, the chassis 21 is mainly formed by a chassis frame 21' which is welded by metal parts, and the incline platform 25 is mainly formed by an inclined frame which is welded by metal parts as well. The upright portion 30 has two symmetrical side rods 31. The bottom end of each side rods 31 is fixed to the front end of the base portion 20 (namely the chassis frame 21'). As shown in FIG. 3, the two side rods 31 are extended upward and gradually inclined toward the center of the exercise equipment.

Figure 4:
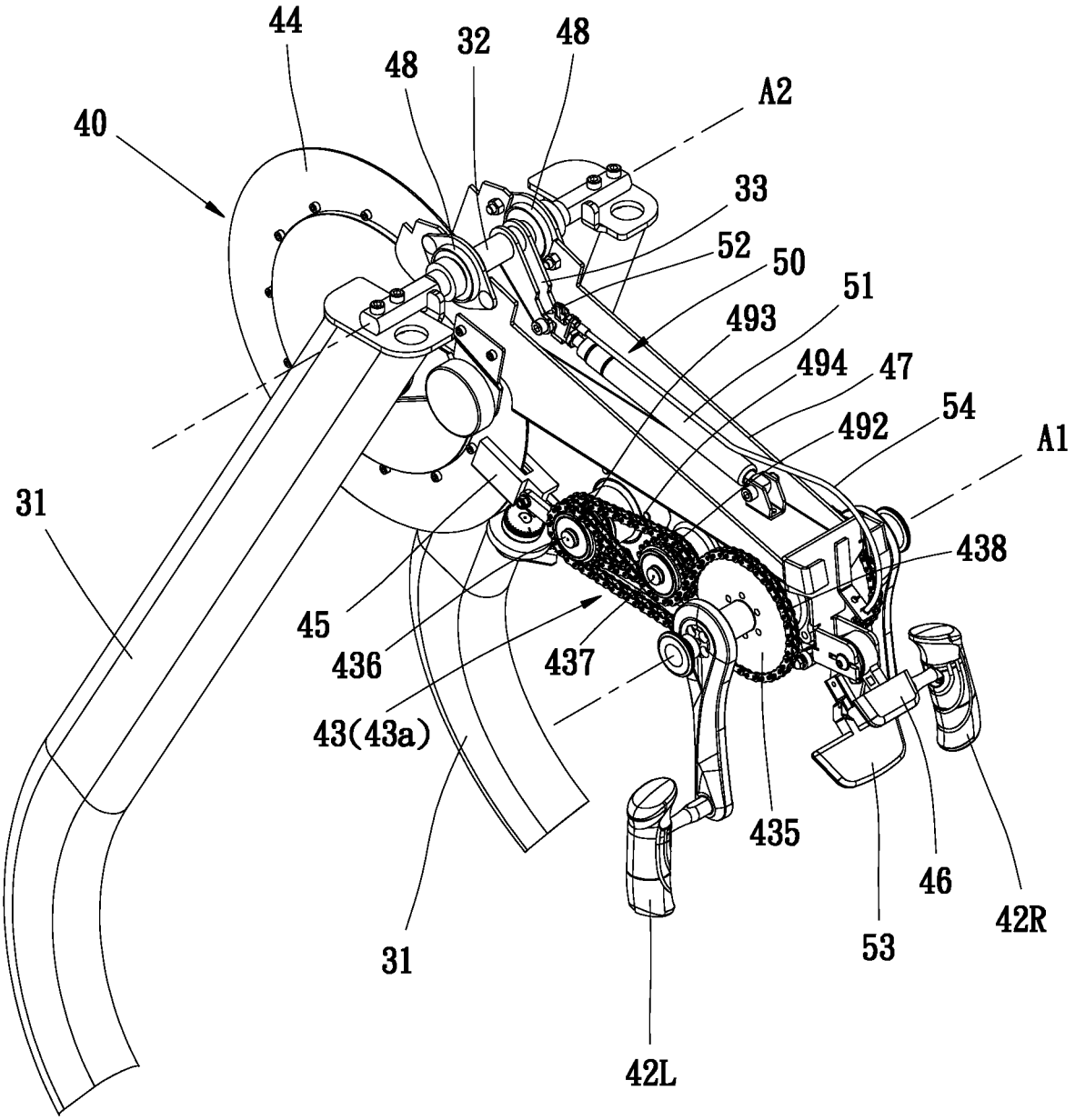
FIG. 4 is a perspective view of a physical exercise device of the upper body exercise apparatus, wherein an outer shell of the physical exercise device is removed for showing interior structure of the physical exercise device.

The physical exercise device 40 is mounted on the upright portion 30 of the frame body 10, specifically, arranged between the top ends of the two side rods 31. As shown in FIG. 4, the outer shell 41 of the physical exercise device 40 is removed for showing interior structure of the physical exercise device 40. The physical exercise device 40 has a left hand pedal 42L and a right hand pedal 42R for allowing the user to grip with their left hand and right hand. The two hand pedals 42L, 42R can rotate synchronously or independently around a first axis A1 along a circular movement path (e.g. the circular path T1 shown in FIG. 2). The first axis A1 corresponds to the lateral direction X of the exercise apparatus. The rotation of the two hand pedals 42L, 42R will drive a flywheel 44 to rotate in place through a plurality of chains and sprockets. Such chains and sprockets form a driving mechanism 43. As shown in FIG. 4, an eddy current brake 45 is provided near the circumference of the flywheel 44. The user can use a resistance adjustment member 46 to adjust the resistance applied by the eddy current brake to the flywheel 44. As shown in FIG. 1 and FIG. 4, the resistance adjustment member 46 is disposed between the left hand pedal 42L and the right hand pedal 42R. Therefore, the user behind the physical exercise device 40 can reach their hands forward to grip the hand pedals 42L, 42R, and then apply a force to rotate hand pedals 42L, 42R about the first axis A1 to perform the upper body exercise along the aforementioned circular movement path, such that each of the hand pedals 42L, 42R forms a moving member.

In other embodiments, the physical exercise device may be provided for allowing hands or feet to perform cycling movement along a closed loop path such as circular or elliptical path, a reciprocating movement along a straight or curved path, or a free movement without a predetermined path (e.g. pulling a rope attached to a weight). The physical exercise in the present invention is not limited to an active exercise that the user's hands or feet apply force to drive the movement of a moving member (e.g. a handle or pedal). In other words, it may also be a passive movement, such as a motor or other power device may be used to drive the moving member to drive the user's hands or feet to move. In addition, in another embodiment, the physical exercise may only have a single moving member.

In the preferred embodiment of the present invention, the physical exercise device 40 is adjustably mounted on the upright portion 30 of the frame body 10. The position of the physical exercise device 40 with respect to the frame body 10 can be adjustable through a position adjusting device 50, so that the height of the circular movement path T1 of the hand pedals 42L, 42R with respect to the base portion 20 of the frame body 10 can be adjustable depending on various usage requirements. Specifically, as shown in FIG. 4, a horizontal shaft 32 is bridged and fixed on the top ends of the two side rods 31. The middle section of the horizontal shaft 32 is cylindrical and its axis (hereinafter referred to as "second axis A2") corresponds to the lateral direction X, and a connecting member 33 is connected to the horizontal shaft 32 and extends rearward from the horizontal shaft 32. The hand pedals 42L, 42R, the driving mechanism 43, the flywheel 44 and the eddy current brake 45 of the physical exercise device 40 are all movably connected to a swing frame 47. The swing frame 47 has a front end pivotally connected to the middle section of the horizontal shaft 32 through two bearings 48, such that the physical exercise device 40 as a whole can be rotatable about the second axis A2. The position adjusting device 50 has a gas lift cylinder 51 (or pneumatic cylinder) which can be linearly retractable. The gas lift cylinder 51 has one end (rear end) pivotally connected to the top rear portion of the swing frame 47 and the other end (front end) pivotally connected to the rear end of the connecting member 33, such that the telescopic movement of the gas lift cylinder 51 is accompanied by the swinging movement of the physical exercise device 40. In other words, the length of the gas lift cylinder 51 determines the position of the physical exercise device 40 with respect to the frame body 10.

Referring to FIG. 4, the position adjusting device 50 further has a first lever 53 disposed between the left hand pedal 42L and the right hand pedal 42R. The user can pull the first lever 53 to pull a valve controlling member 52 at the front end of the gas lift cylinder 51 through a steel cable 54, so that the length of the gas lift cylinder 51 is variable and the position of the physical exercise device 40 can be adjustable at this time. For example, if the user makes the physical exercise device 40 swing counterclockwise from a first position shown in FIG. 2 to a second position shown in FIG. 16, namely the rear end of the physical exercise device 40 is raised, the gas lift cylinder 51 will be extended correspondingly. When the gas lift cylinder 51 is extended to the longest length, the physical exercise device 40 will stop at the position shown in FIG. 16, and the circular movement path T1' of the two hand pedals 42L, 42R is located at an uppermost position. In contrast, when the gas lift cylinder 51 is in the length variable state, if the user forces to make the physical exercise device 40 swing clockwise from the second position shown in FIG. 16 to the first position shown in FIG. 2, namely the rear end of the physical exercise device 40 is lowered, the gas lift cylinder 51 will be shortened correspondingly. When the gas lift cylinder 51 is shortened to the shortest length, the physical exercise device 40 will stop at the position shown in FIG. 2, and the circular movement path T1 of the two hand pedals 42L, 42R is located at a lowermost position. When the user releases the first lever 53, the valve controlling member 52 will return to the original position, so that the gas lift cylinder 51 is fixed at the current length, and the physical exercise device 40 will be positioned at the current position.

Figure 16:
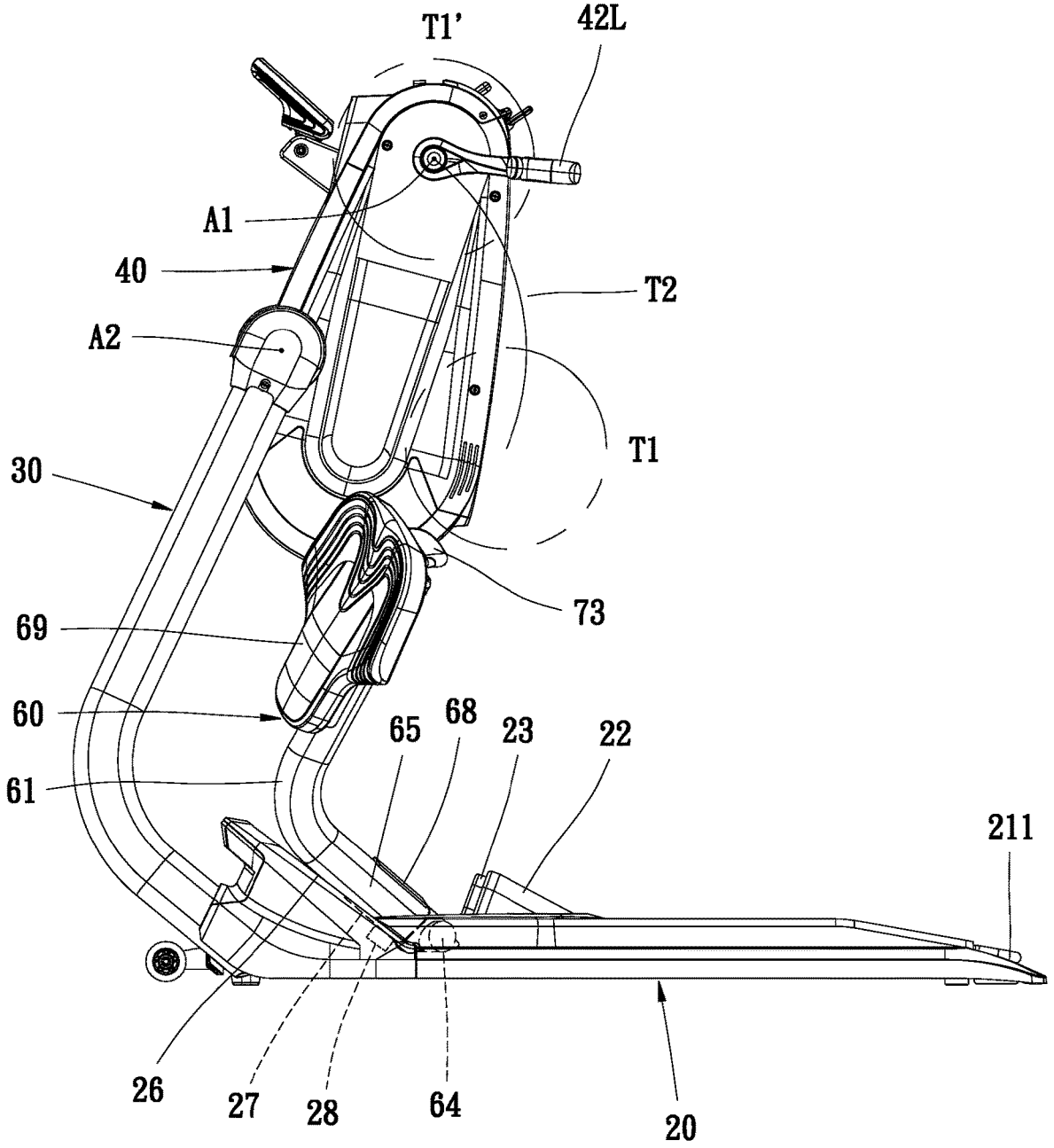
FIG. 16 is a side view of the upper body exercise apparatus shown in FIG. 15.

By means of the aforementioned position adjusting function of the physical exercise device 40, the user is able to adjust the physical exercise device 40 to a most suitable position according to the posture (sitting or standing) while using the physical exercise device 40 to perform the upper body exercise and individual body shapes and habits. It is to adjust the circular movement path of the two hand pedals 42L, 42R (namely the movement path of the user's hands) to a most suitable height. As shown in FIG. 2 and FIG. 16, the physical exercise device 40 is pivotally mounted on the upright portion 30 of the body frame 10 according to the second axis A2. When the physical exercise device 40 is adjusted relative to the frame body 10, the center of the circular movement path of the two hand pedals 42L, 42R (namely the first axis A1) will move up and down along an arc adjustment path T2 about the second axis A2. Since the length of the aforementioned gas lift cylinder 51 can be steplessly adjustable, the user can adjust the center of the aforementioned circular movement path at any position on the arc adjustment path T2.

In general, the height of the hand pedals 42L, 42R suitable for a user to perform the aforementioned upper body exercise in a standing position is higher than the height of the hand pedals 42L, 42R suitable for the same user to perform the upper body exercise in a sitting position. For example, the position of the physical exercise device 40 shown in FIG. 2 is suitable for being operated in a sitting position (referred to as "sitting suitable position" hereinafter), and the position of the physical exercise device 40 shown in FIG. 16 is suitable for being operated in a standing position (referred to as "standing suitable position" hereinafter).

Figure 5:
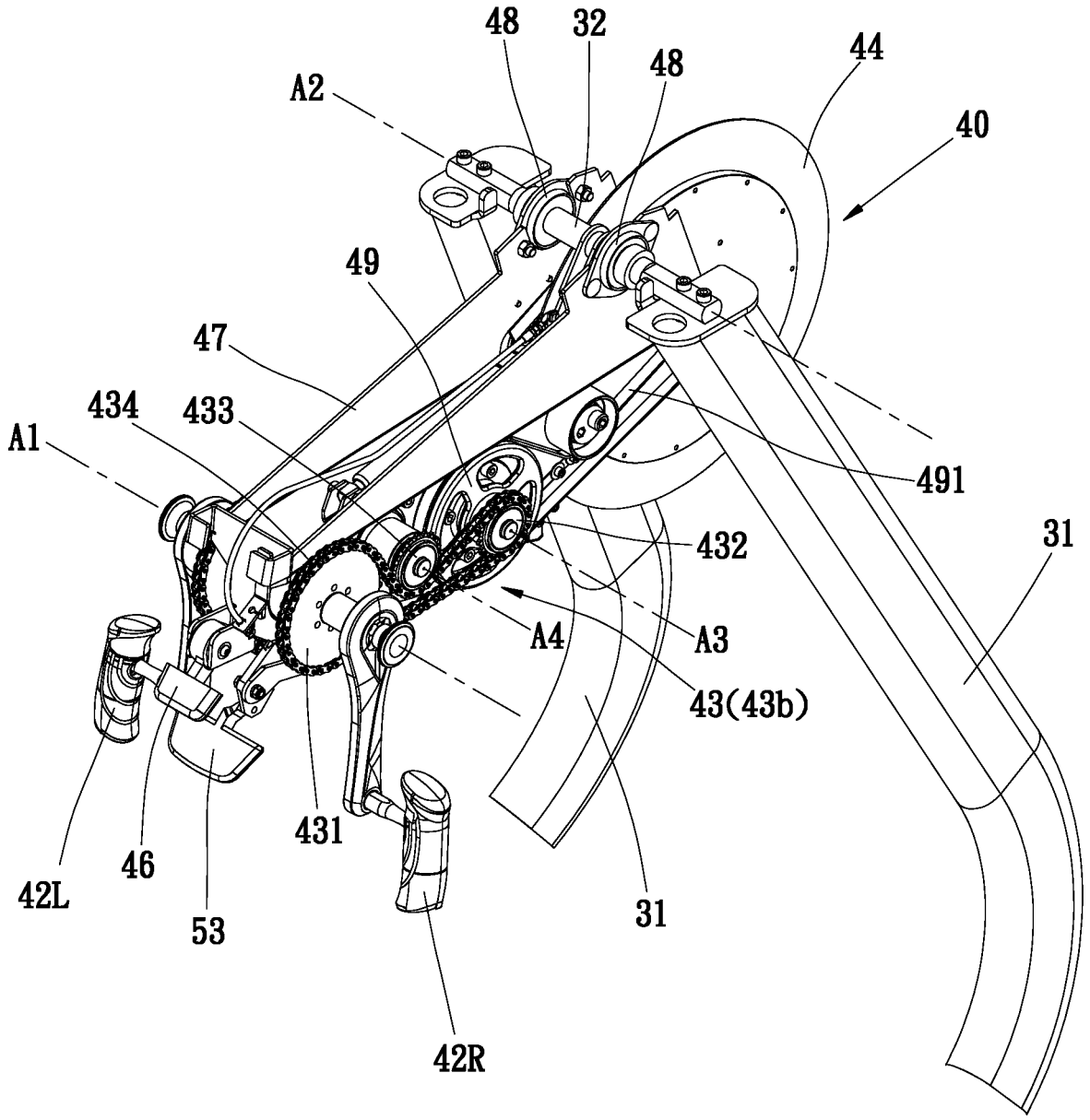
FIG. 5 is a perspective view of the physical exercise device shown in FIG. 4 taken from another angle.

Referring to FIG. 4 and FIG. 5, the driving mechanism 43 is divided into a left driving mechanism 43*a* and a right driving mechanism 43*b* respectively coupled to the flywheel 44. Both the left driving mechanism 43*a* and the right driving mechanism 43*b* can be operated to drive the flywheel 44. The left driving mechanism 43*a* is mounted between the left hand pedal 42L and the flywheel 44, such that rotation of the left hand pedal 42L will drive rotation of the flywheel 44. The right driving mechanism 43*b* is mounted between the right hand pedal 42R and the flywheel 44, such that rotation of the right hand pedal 42R will drive rotation of the flywheel 44 as well. In this manner, the user can operate the left hand pedal 42L and/or the right hand pedal 42R to perform the upper body exercise.

Figure 7:
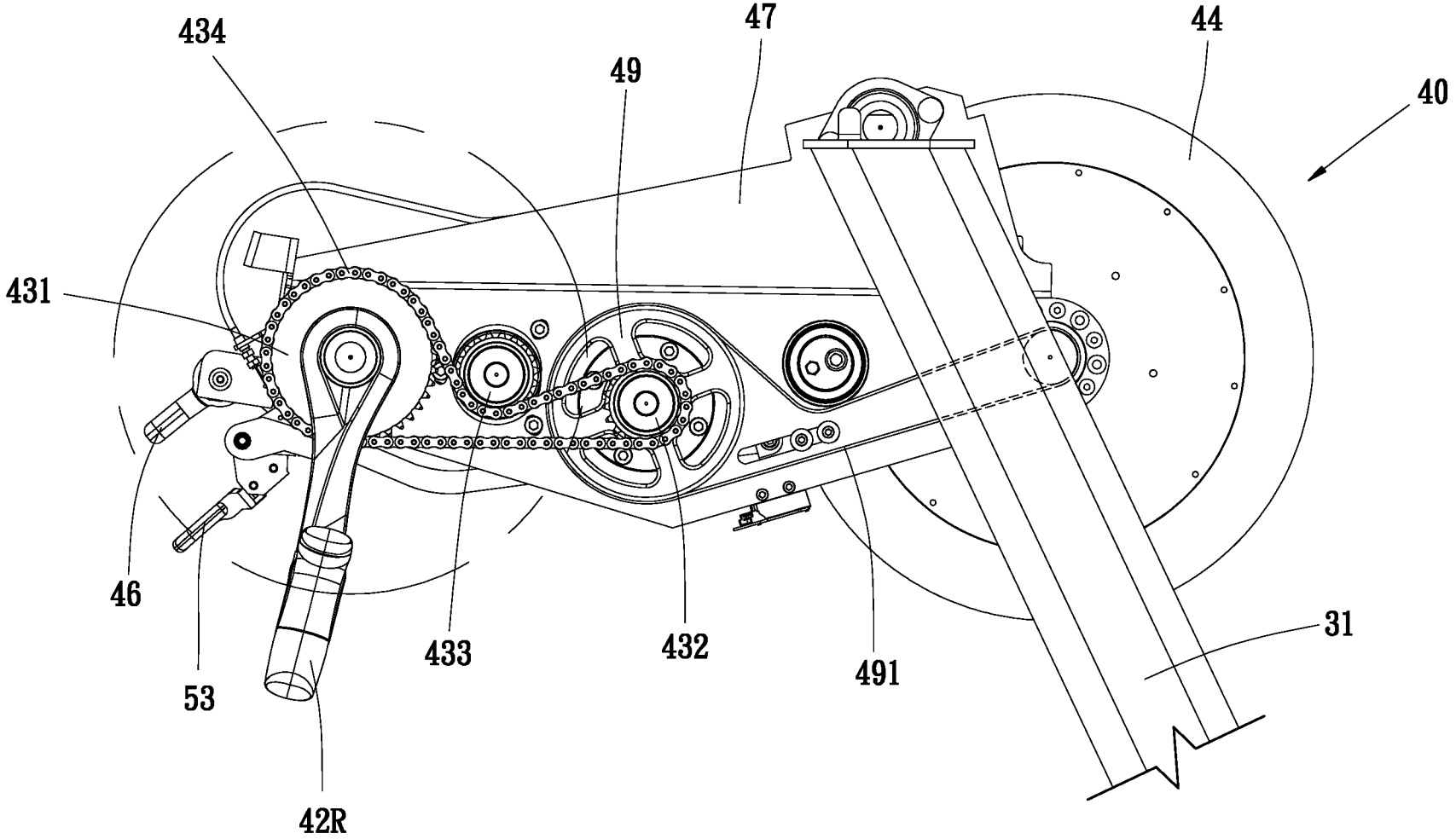
FIG. 7 is a right side view of the physical exercise device shown in FIG. 4.

In the preferred embodiment, the left driving mechanism 43*a* is interconnected with the right driving mechanism 43*b*. FIG. 5 shows the detail configuration of the right driving mechanism 43*b*. The right driving mechanism 43*b* has a first chain wheel 431, a first sprocket 432, a second sprocket 433, and a first driving chain 434. The first chain wheel 431 is mounted on the right side of the swing frame 47 about the first axis A1 and coupled to the right hand pedal 42R, such that rotation of the right hand pedal 42R drives rotation of the first chain wheel 431. As shown in FIG. 5 and FIG. 7, the driving mechanism 43 has a pulley 49 mounted on the swing frame 47 about a third axis A3 and a transmission belt 491 mounted around the pulley 49 and the central shaft of the flywheel 44, such that rotation of the pulley 49 will drive rotation of the flywheel 44. The first sprocket 432 is coaxially coupled to the pulley 49 and the first driving chain 434 is mounted around the first chain wheel 431 and the first sprocket 432. When the user is pedaling the right hand pedal 42R, the first chain wheel 431 will rotate simultaneously to drive rotation of the first sprocket 432 through the first driving chain 434, and rotation of the first sprocket 432 will drive the pulley 49 to drive the flywheel 44 through the transmission belt 491 for allowing the user to perform the upper body exercise. As shown in FIG. 7, the second sprocket 433 is mounted on the swing frame 47 about a fourth axis A4 and disposed between the first chain wheel 431 and the first sprocket 432 and engaged with the first driving chain 434 (e.g. the outer side of the first driving chain 434), so that rotation of the first driving chain 434 will also drive the second sprocket 433 to rotate.

In the preferred embodiment, rotation of the first driving chain 434 will drive the first sprocket 432 and the second sprocket 433 to rotate in opposite directions. For example, when the first sprocket 432 is rotated in a forward direction (e.g. clockwise direction in FIG. 7), the second sprocket 433 is rotated in a reverse direction (e.g. counterclockwise direction in FIG. 7). Specifically, the first sprocket 432 is a clutch sprocket, namely a one-way clutch mechanism or a uni-directional clutch. For example, when the right hand pedal 42R is operated to be rotated in the forward direction, the first sprocket 432 will be engaged with the pulley 49 to drive the pulley 49 to rotate in the forward direction and further drive the flywheel 44 to rotate. In contrast, when the right hand pedal 42R is operated to be rotated in the reverse direction, the first sprocket 432 will be disengaged with the pulley 49, namely rotation of the first sprocket 432 in the reverse direction does not drive the pulley 49.

Figure 8:
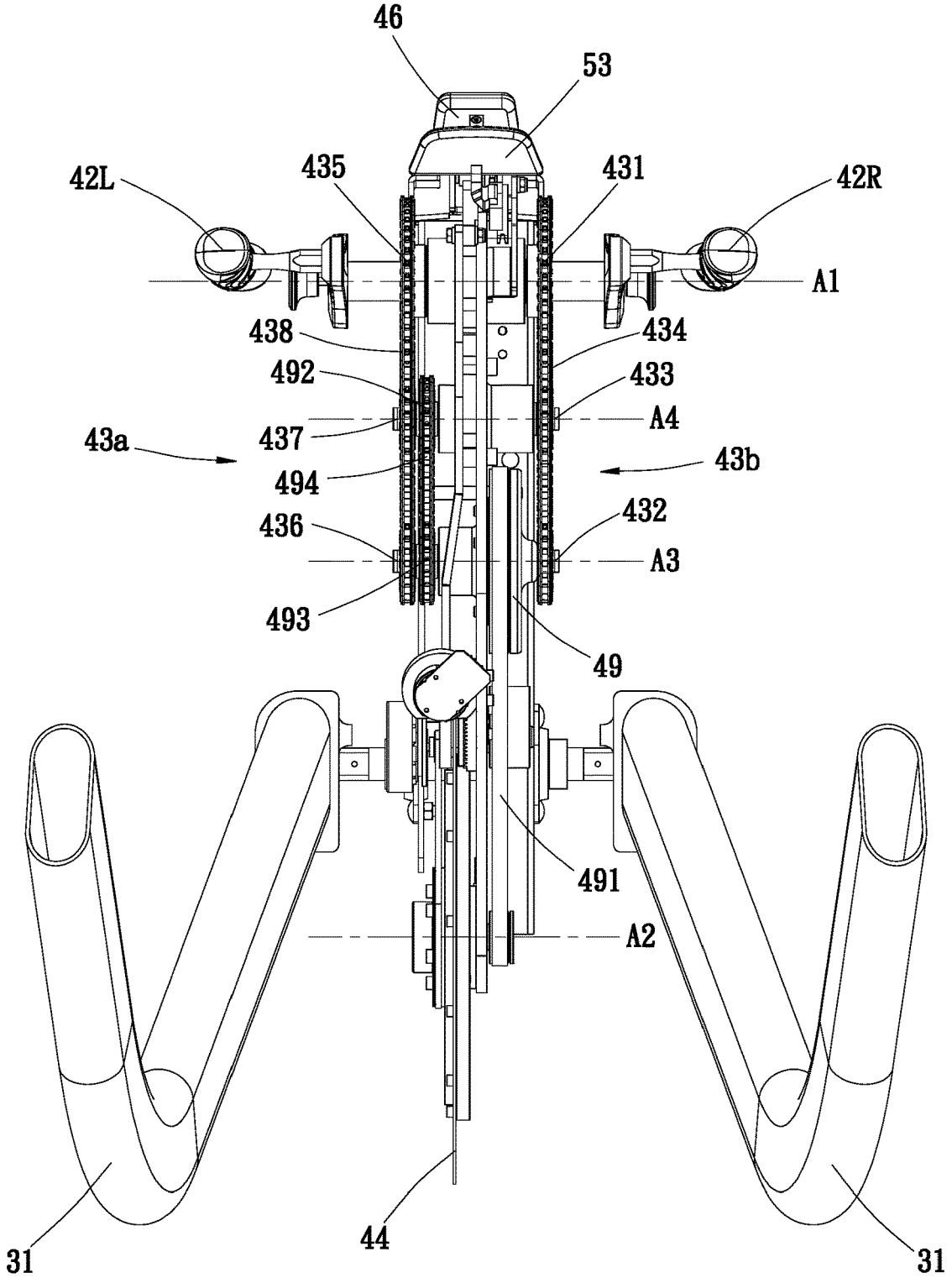
FIG. 8 is a bottom view of the physical exercise device shown in FIG. 4.

As shown in FIG. 7, when the right hand pedal 42R is operated to be rotated in the reverse direction, the first sprocket 432 is rotated in the reverse direction and the second sprocket 433 is rotated in the forward direction opposite to the rotation direction of the first sprocket 432. As shown in FIG. 4 and referring to FIG. 8, the left driving mechanism 43*a* has a first driven sprocket 492 coaxially coupled to the second sprocket 433 of the right driving mechanism 43*b*, a second driven sprocket 493 coaxially coupled to the pulley 49, and a second driving chain 494 mounted around the first driven sprocket 492 and the second driven sprocket 493 so that rotation of the first driven sprocket 492 drives rotation of the second driven sprocket 493 through the second driving chain 494 to drive the pulley 49 and the flywheel 44. Specifically, the second sprocket 433 is a clutch sprocket, when the second sprocket 433 is rotated in the forward direction, namely the right hand pedal 42R is operated to be rotated in the reverse direction, the second sprocket 433 will be engaged with the first driven sprocket 492 to drive the first driven sprocket 492 to rotate in the forward direction, and rotation of the first driven sprocket 492 will drive rotation of the second driven sprocket 493 and the pulley 49 so as to drive the flywheel 44. In contrast, when the right hand pedal 42R is operated to be rotated in the forward direction, the second sprocket 433 will be disengaged with the first driven sprocket 492, namely rotation of the second sprocket 433 in the reverse direction will not drive rotation of the flywheel 44.

Under this arrangement, when the right hand pedal 42R is operated to be rotated in the forward direction, the flywheel 44 will be driven by the first sprocket 432, and when the right hand pedal 42R is operated to be rotated in the reverse direction, the flywheel 44 will be driven by the second sprocket 433. It should be noted that no matter the right hand pedal 42R is operated to be rotated in the forward direction or reverse direction, namely rotated clockwise or counterclockwise, the flywheel 44 is always rotated in the forward direction, such that the right hand pedal 42R can be switched between forward rotation and backward rotation smoothly.

Figure 6:
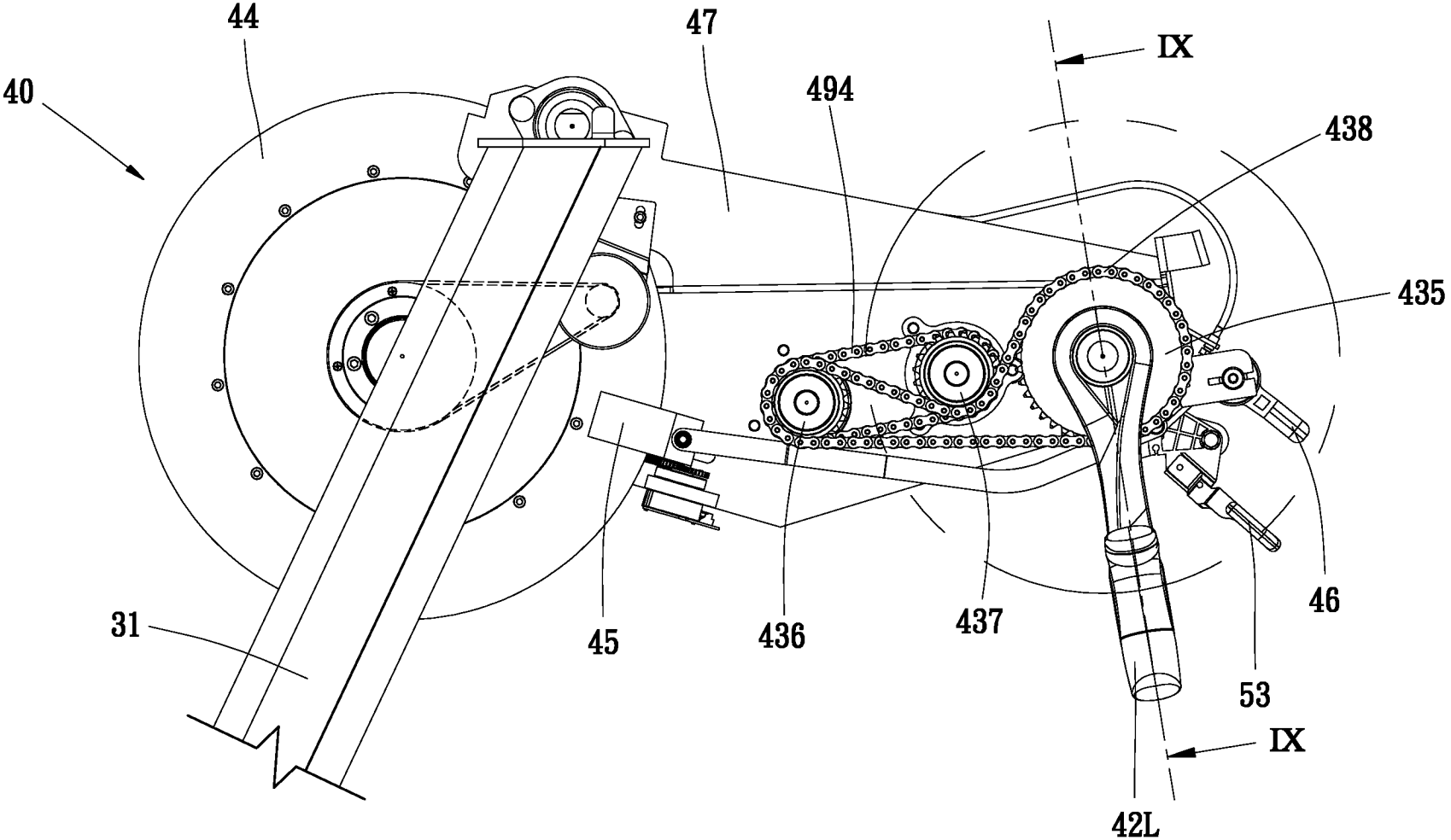
FIG. 6 is a left side view of the physical exercise device shown in FIG. 4.

Referring to FIG. 4 and FIG. 6, the left driving mechanism 43*a* has a second chain wheel 435, a third sprocket 436, a fourth sprocket 437, and a third driving chain 438. The second chain wheel 435 is mounted on the left side of the swing frame 47 opposite to the first chain wheel 431 about the first axis A1 and coupled to the left hand pedal 42L, such that rotation of the left hand pedal 42L drives rotation of the second chain wheel 435. The third sprocket 436 is coaxially coupled to the pulley 49 and located next to the second driven sprocket 493. As shown in FIG. 4 and referring to FIG. 8, the third sprocket 436 is located at the outer side of the second driven sprocket 493. The third driving chain 438 is mounted around the second chain wheel 435 and the third sprocket 436. When the user is pedaling the left hand pedal 42L, the second chain wheel 435 will rotate simultaneously to drive rotation of the third sprocket 436 through the third driving chain 438, and rotation of the third sprocket 436 will drive the pulley 49 to drive the flywheel 44 through the transmission belt 491 for allowing the user to perform the upper body exercise. As shown in FIG. 6, the fourth sprocket 437 is mounted on the swing frame 47 about the fourth axis A4 and disposed between the second chain wheel 435 and the third sprocket 436 and engaged with the third driving chain 438 (e.g. the outer side of the third driving chain 438), so that rotation of the third driving chain 438 will also drive the fourth sprocket 437 to rotate. The fourth sprocket 437 is coaxially coupled to the first driven sprocket 492 and located next to the first driven sprocket 492. As shown in FIG. 4 and referring to FIG. 8, the fourth sprocket 437 is located at the outer side of the first driven sprocket 492.

In the preferred embodiment, rotation of the third driving chain 438 will drive the third sprocket 436 and the fourth sprocket 437 to rotate in opposite directions. For example, when the third sprocket 436 is rotate in the forward rotation (e.g. counterclockwise direction in FIG. 6), the fourth sprocket 437 is rotated in the reverse direction (e.g. clockwise direction in FIG. 6). Specifically, both the third sprocket 436 and the fourth sprocket 437 are clutch sprockets. For example, when the left hand pedal 42L is operated to be rotated in the forward direction, the third sprocket 436 will be engaged with the pulley 49 to drive the pulley 49 to rotate in the forward direction and further drive the flywheel 44 to rotate. In contrast, when the left hand pedal 42L is operated to be rotated in the reverse direction, the third sprocket 436 will be disengaged with pulley 49, namely rotation of the third sprocket 436 in the reverse direction does not drive the pulley 49.

As shown in FIG. 6, when the left hand pedal 42L is operated to be rotated in the reverse direction, the third sprocket 436 is rotated in the reverse direction and the fourth sprocket 437 is rotated in the forward direction opposite to the rotation direction of the third sprocket 436. Referring to FIG. 4 and FIG. 6, when the fourth sprocket 437 is rotated in the forward direction, the fourth sprocket 437 will be engaged with the first driven sprocket 492 to drive the first driven sprocket 492 to rotate in the forward direction, and rotation of the first driven sprocket 492 will drive rotation of the second driven sprocket 493 and the pulley 49 so as to drive the flywheel 44. In contrast, when the left hand pedal 42L is operated to be rotated in the forward direction, the fourth sprocket 437 will be disengaged with the first driven sprocket 492, namely rotation of the fourth sprocket 437 in the reverse direction will not drive rotation of the flywheel 44.

Under this arrangement, when the left hand pedal 42L is operated to be rotated in the forward direction, the flywheel 44 will be driven by the third sprocket 436, and when the left hand pedal 42L is operated to be rotated in the reverse direction, the flywheel 44 will be driven by the fourth sprocket 437. It should be noted that no matter the left hand pedal 42L is operated to be rotated in the forward direction or reverse direction, namely rotated clockwise or counterclockwise, the flywheel 44 is always rotated in the forward direction, such that the left hand pedal 42L can be switched between forward rotation and backward rotation smoothly.

In the preferred embodiment of the present invention, the flywheel 44 is configured for providing an exercise resistance for allowing the user to perform the upper body exercise. Since the flywheel 44 is always rotated in the forward direction, the use can operate the left hand pedal 42L and right hand pedal 42R to perform forward or backward rotating movement and can be switched between the aforementioned two exercise modes smoothly.

Figure 9:
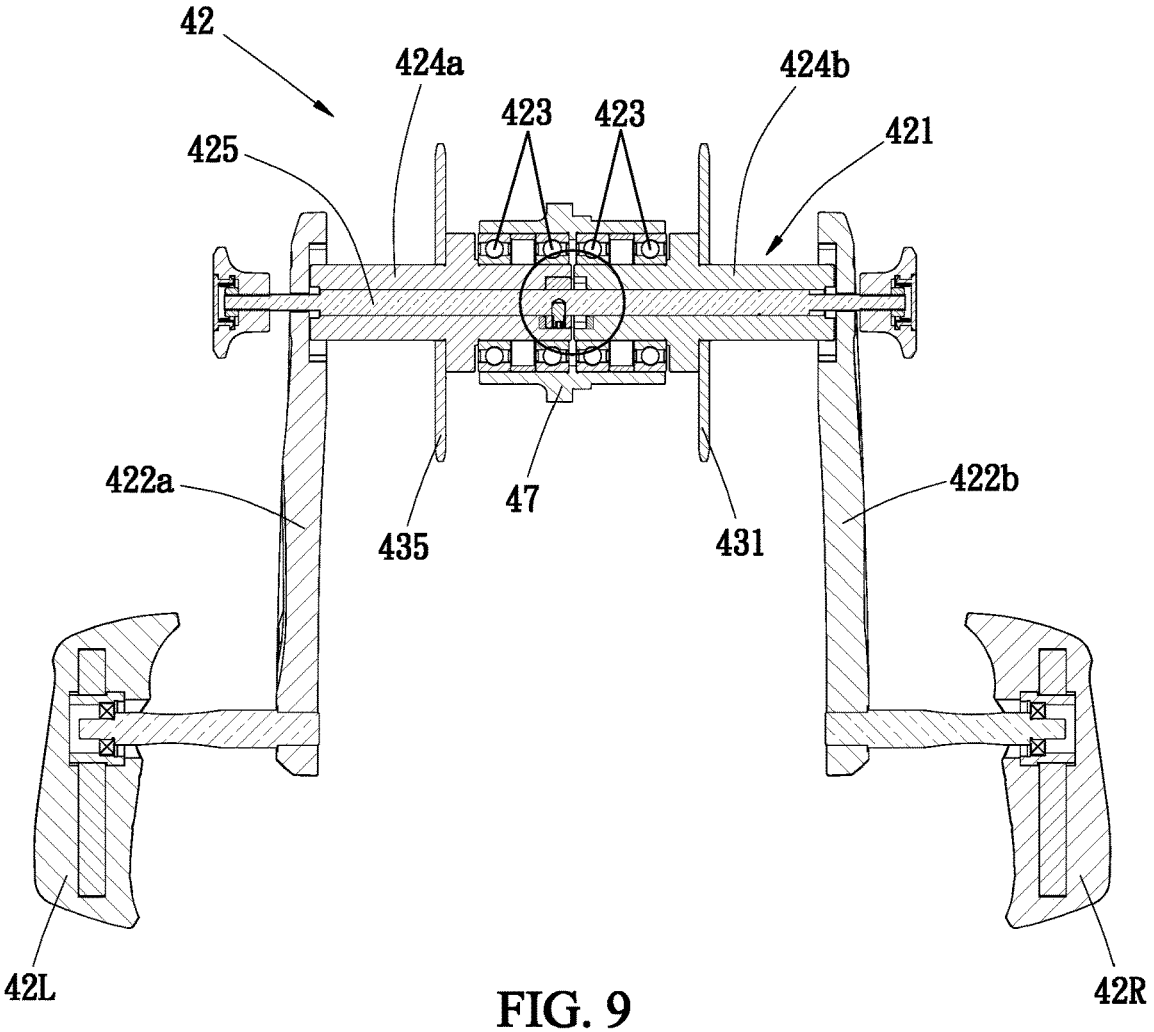
FIG. 9 is a cross-sectional view along line IX-IX of FIG. 6.

FIG. 9 is a cross-sectional view along line IX-IX of FIG. 6, showing a crank mechanism 42 of the physical exercise device 40 in accordance with the preferred embodiment of the present invention. The crank mechanism 42 includes a crank shaft assembly 421 and two crank arms 422*a*, 422*b* respectively mounted on two ends of the crank shaft assembly 421. The crank shaft assembly 421 is rotatably mounted on the swing frame 47 about the first axis A1, and a plurality of bearings 423 are axially mounted around the crank shaft assembly 421 within the swing frame 47. The left hand pedal 42L is mounted on the distal end of the left crank arm 422*a* opposite to the crank shaft assembly 421. The right hand pedal 42R is mounted on the distal end of the right crank arm 422*b* opposite to the crank shaft assembly 421. The user can operate the two hand pedals 42L, 42R to rotate the two crank arms 422*a*, 422*b*, and rotation of the two crank arms 422*a*, 422*b* cause rotation of the crank shaft assembly 421.

In the preferred embodiment of the present invention, the crank shaft assembly 421 having a left crank shaft 424*a*, a right crank shaft 424*b*, and a central shaft 425 passing through the left crank shaft 424*a* and the right crank shaft 424*b*. The left crank shaft 424*a* has one end rotatably mounted to the swing frame 47 within the bearings 423 and the other end connected to the left crank arm 422*a*. As shown in FIG. 9, the second chain wheel 435 is fixed to the left crank shaft 424*a*, such that rotation of the left crank shaft 424*a* causes rotation of the second chain wheel 435 simultaneously. Similarly, the right crank shaft 424*b* has one end rotatably mounted to the swing frame 47 within the bearings 423 and the other end connected to the right crank arm 422*b*. The first chain wheel 431 is fixed to the right crank shaft 424*b*, such that rotation of the right crank shaft 424*b* causes rotation of the first chain wheel 431 simultaneously.

Figure 10:
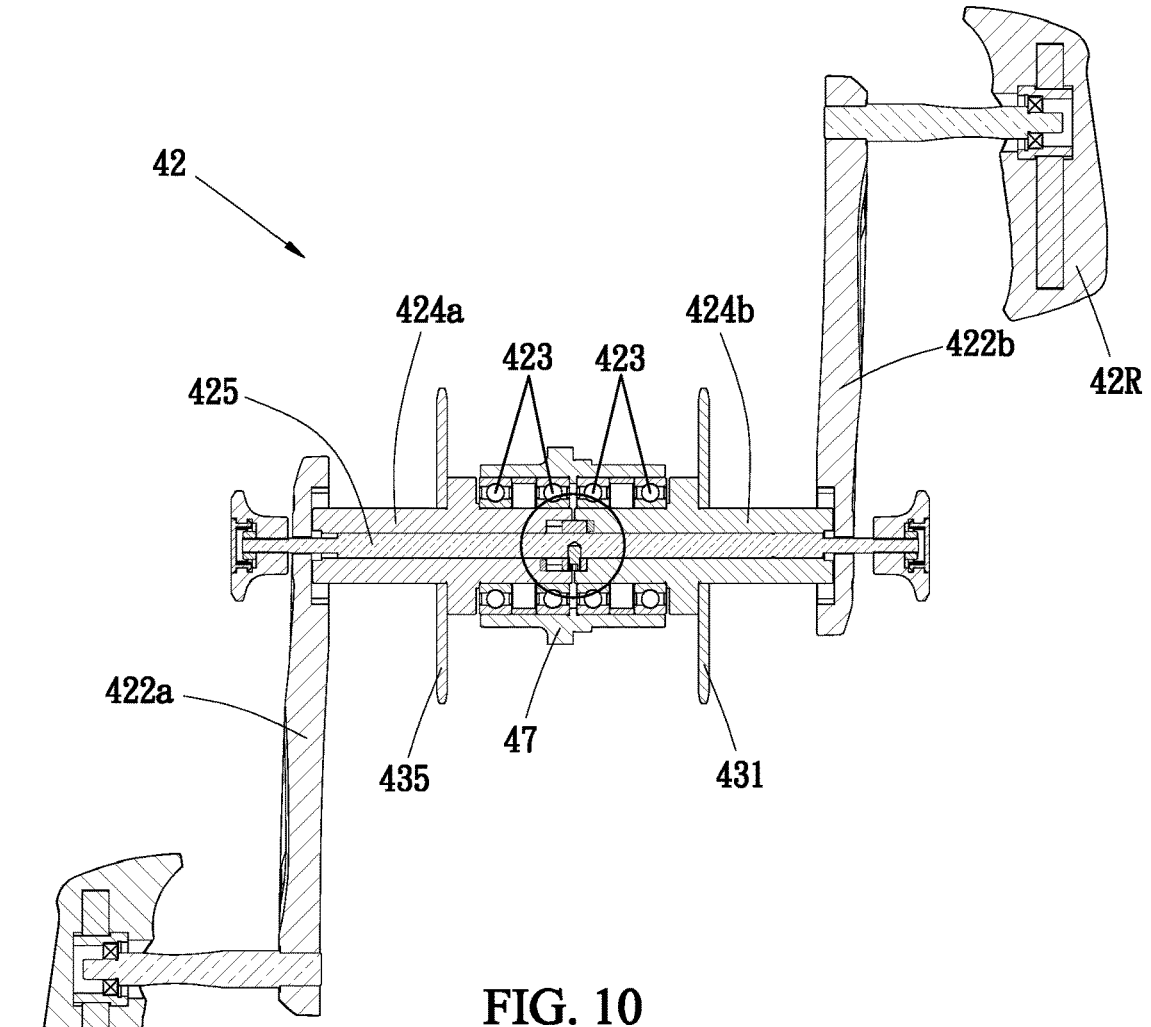
FIG. 10 is similar to FIG. 9, but showing that two crank arms are positioned in an opposed orientation with the crank arms 180 degrees apart.

In the preferred embodiment of the present invention, the two hand pedals 42L, 42R can be adjustable in their orientation relative to each other so that the two hand pedals 42L, 42R can be arranged alternately or synchronously. For example, FIG. 9 illustrates the left hand pedal 42L and the right hand pedal 42R are arranged synchronously, namely the two crank arms 422*a*, 422*b* are positioned side by side and maintained at zero degrees relative to each other. FIG. 10 illustrates the left hand pedal 42L and the right hand pedal 42R are arranged alternately, namely the two crank arms 422*a*, 422*b* are positioned in an opposed orientation and maintained at 180 degrees opposite to each other.

Figure 9A:
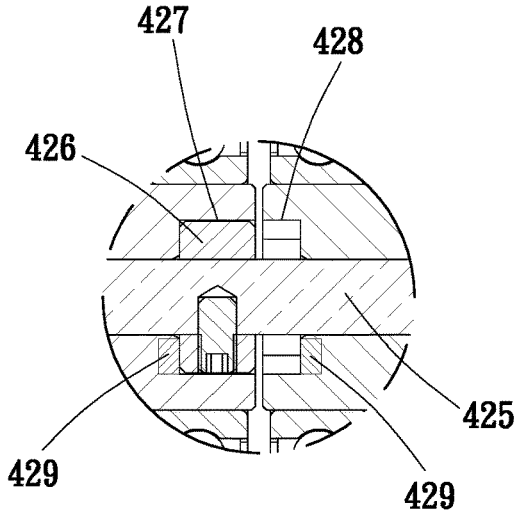
FIGS. 9A and 9B are enlarged views of FIG. 9 for showing a locking mechanism.
Figure 9B:
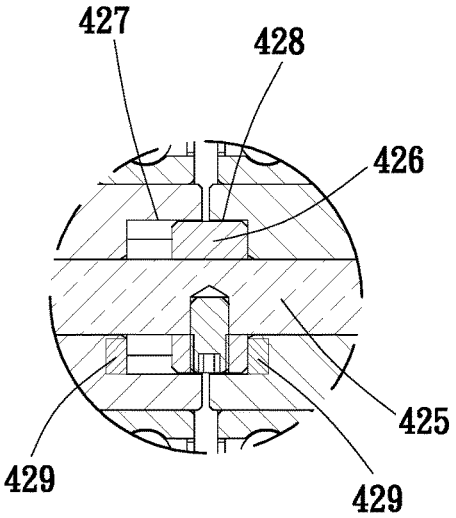

As shown in FIG. 9 and referring to FIG. 9A and FIG. 9B, the left crank shaft 424*a* and the right crank shaft 424*b* can be operable to be engaged with each other or disengaged with each other via a locking mechanism, so that the left hand pedal 42L and the right hand pedal 42R can be rotated dependently or independently, and the two crank arms 422*a*, 422*b* can be adjustably positioned at a predetermined angle relative to each other. As shown in FIG. 9A and FIG. 9B, the locking mechanism is disposed in the crank shaft assembly 421 between the left crank shaft 424*a* and the right crank shaft 424*b*. The locking mechanism has a blocking member 426, a first cavity 427 defined in the distal end of the left crank shaft 424*a* opposite to the left crank arm 422*a*, and a second cavity 428 defined in the distal end of the right crank shaft 424*b* opposite to the right crank arm 422*b*. The first cavity 427 can be sized and shaped to receive the blocking member 426, as shown in FIG. 9A. The second cavity 428 can be sized and shaped to partially receive the blocking member 426, as shown in FIG. 9B.

In the preferred embodiment of the present invention, the central shaft 425 is movable within the left crank shaft 424*a* and the right crank shaft 424*b*. The blocking member 426 is fixed on the middle portion of the central shaft 425, such that axial motion of the central shaft 425 will drive the blocking member 426 to move axially between the first cavity 427 and the second cavity 428. The first cavity 427 and the second cavity 428 are non-circular holes such as polygonal holes or rectangular holes, and the blocking member 426 has a cross section that is non-circular in shape (e.g. polygonal or rectangular) fitted with the first cavity 427 and the second cavity 428. The blocking member 426 can be pulled by the central shaft 425 to be moved between a lock position and a unlock position. When the blocking member 426 is in the unlock position, the blocking member 426 is all received in the first cavity 427, as shown in FIG. 9A, such that the left crank shaft 424*a* is not engaged with the right crank shaft 424*b*. Thus, the left crank shaft 424*a* and the right crank shaft 424*b* can be rotated independently, namely the left hand pedal 42L and the right hand pedal 42R can be rotated independently. When the blocking member 426 is in the lock position, the blocking member 426 is partially received in the first cavity 427 and the second cavity 428, as shown in FIG. 9B, such that the left crank shaft 424*a* is engaged with the right crank shaft 424*b*. Thus, the left crank shaft 424*a* and the right crank shaft 424*b* can be rotated dependently, namely the left hand pedal 42L and the right hand pedal 42R can be rotated dependently. In this manner, the relative angle between the two crank arms 422*a*, 422*b* can be fixed at a certain angel through the aforementioned locking mechanism.

Figure 10A:
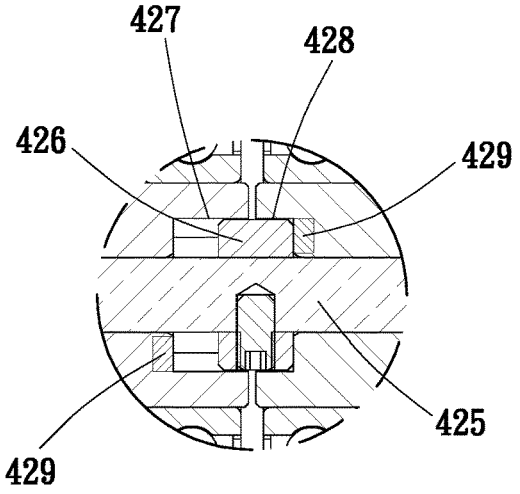
FIG. 10A is an enlarged view of FIG. 10.

Referring to FIG. 9 and FIG. 10, the central shaft 425 can be operated to move axially to drive the blocking member 426 to be moved between the lock position and the unlock position. As shown in FIG. 9, two knobs may be respectively fixed at two ends of the central shaft 425 for allowing the user to manually move the central shaft 425 so as to adjust the orientation of the two crank arms 422*a*, 422*b*. As shown in FIG. 9 and referring to FIG. 9B, the two crank arms 422*a*, 422*b* are arranged at the same side. As shown in FIG. 10 and referring to FIG. 10A, the two crank arms 422*a*, 422*b* are arranged at opposite sides. In addition, each of the left crank shaft 424*a* and the right crank shaft 424*b* may have a magnet 429 disposed in the respective cavities 427, 428. The magnets 429 may be partially attracted the blocking member 426 at the unlock position (as shown in FIG. 9A) or the lock position (as shown in FIG. 9B). Referring to FIG. 9B and FIG. 10A, the magnets 429 may be provided to identify the relative angle between the two crank arms 422*a*, 422*b*.

Figure 12:
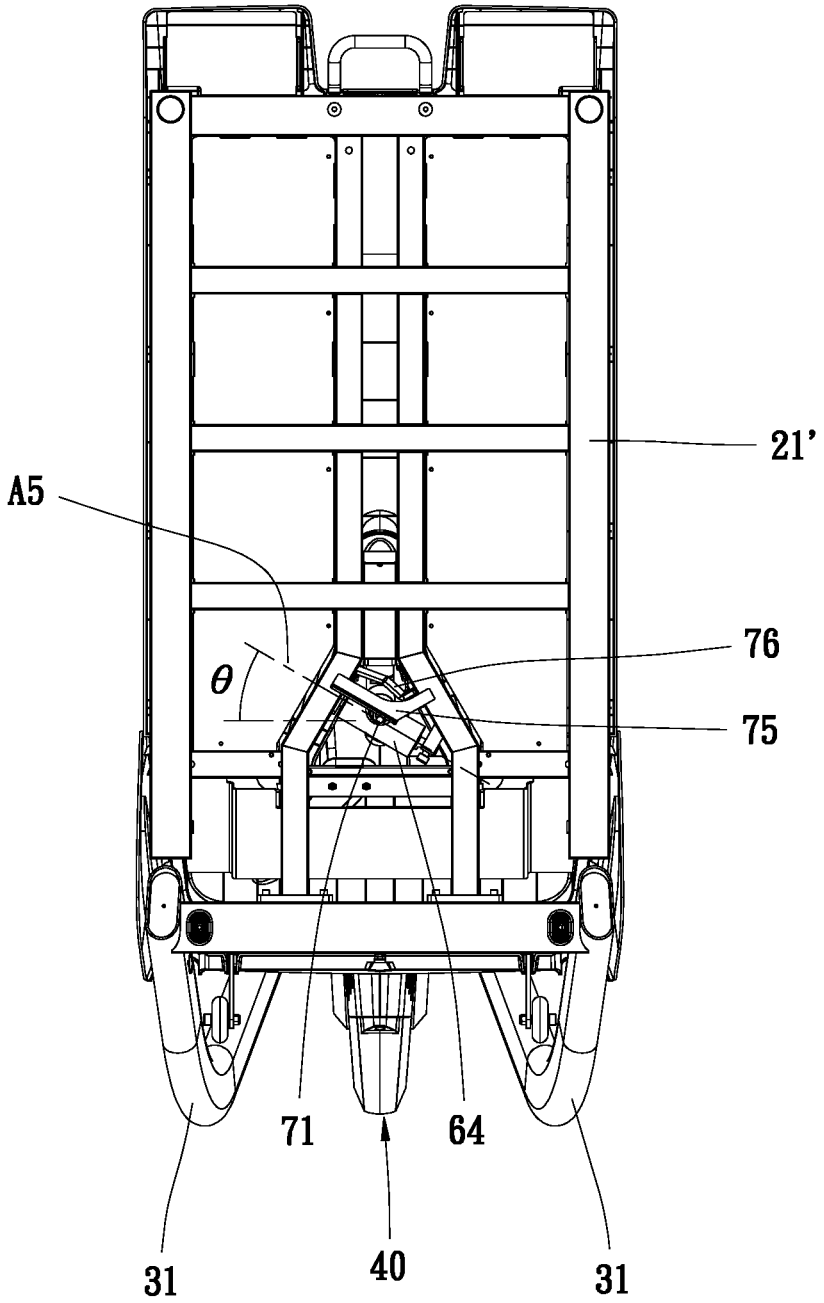
FIG. 12 is a bottom view of the upper body exercise apparatus shown in FIG. 11.
Figure 13:
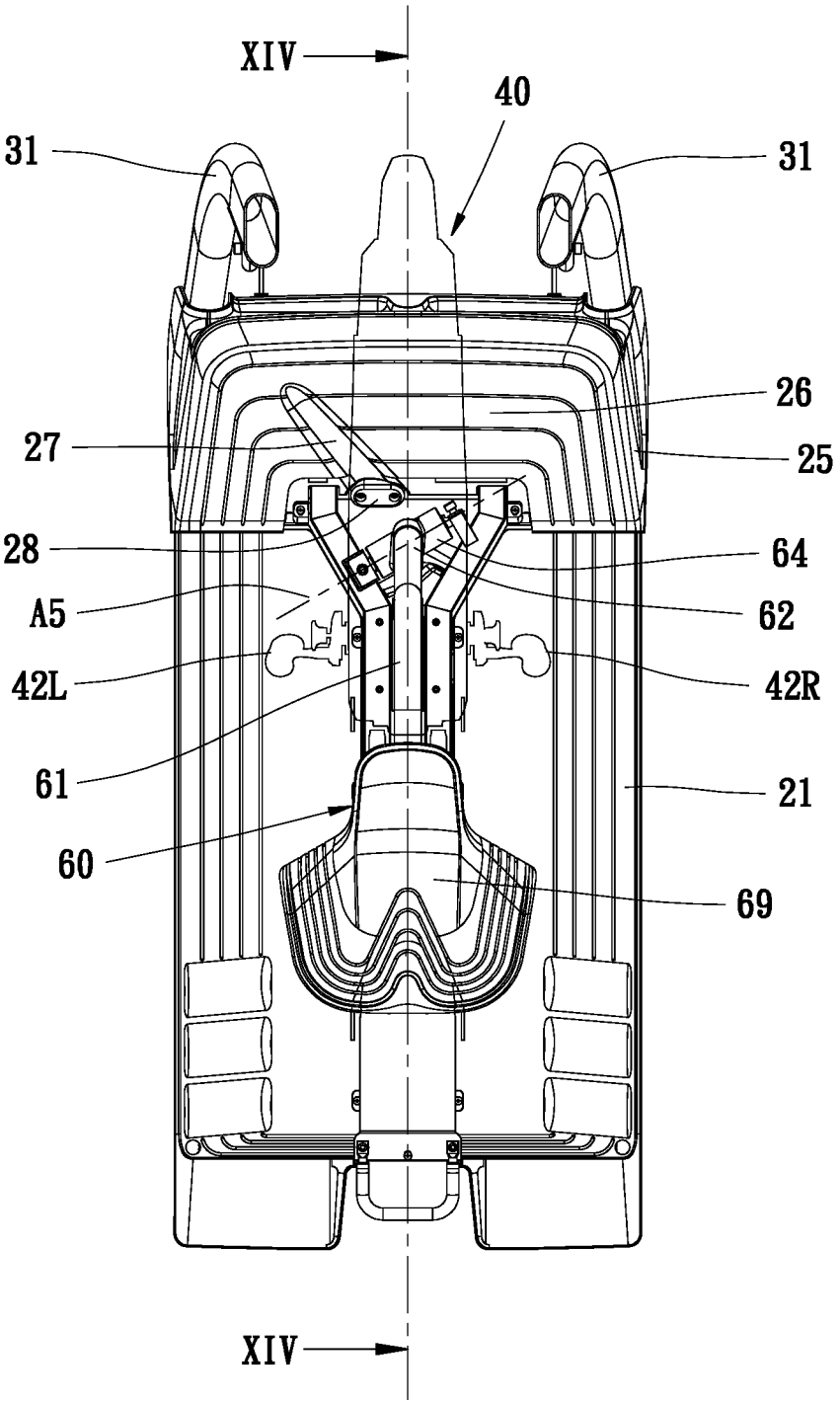
FIG. 13 is a top view of the upper body exercise apparatus shown in FIG. 1.

Back referring to FIG. 1 to FIG. 3, the exercise apparatus of the present invention has a movable seat 60 mounted on the base portion 20 of the frame body 10. The movable seat 60 has a seat post 61 and a seat portion 69. The seat post 61 is made of metal pipe and has a first end 62 and a second end 63 which is located higher than the first end 62. The seat post 61 has an inclined section 65 adjacent to the first end 62, a straight section 67 adjacent to the second end 63, and a bending section 66 between the inclined section 65 and the straight section 67. Referring to FIG. 11 to FIG. 13, a barrel 64 is welded to the first end 62 of the seat post 61. The barrel 64 is pivotally connected to the base portion 20 of the frame body 10 according to the central axis of the barrel 64 (referred to as a pivot axis A5 hereinafter). Specifically, the first end 62 of the seat post 61 is pivotally connected to the lateral center of the chassis frame 21' near the rear edge of the inclined platform 25. The aforementioned pivot axis A5 is not parallel to the longitudinal direction Z, the lateral direction X and the vertical direction Y of the exercise apparatus. In the preferred embodiment, the pivot axis A5 is located on a horizontal plane (namely the X-Z plane) as a horizontal line extending from the rear left to the front right. The included angle between the pivot axis A5 and the lateral direction X of the exercise apparatus may range between 15 degrees to 75 degrees depending on implementation choices. For example, as shown in FIG. 12, the included angle between the pivot axis A5 and the lateral direction X of the exercise apparatus is 30 degrees. In another embodiment, the pivot axis A5 may not be a horizontal line, e.g. the right end of the axis is higher than the left end, or vice versa. The seat portion 69 is fixed on the second end 63 of the seat post 61 for supporting the buttocks of the user who is performing the upper body exercise in a sitting position.

Figure 15:
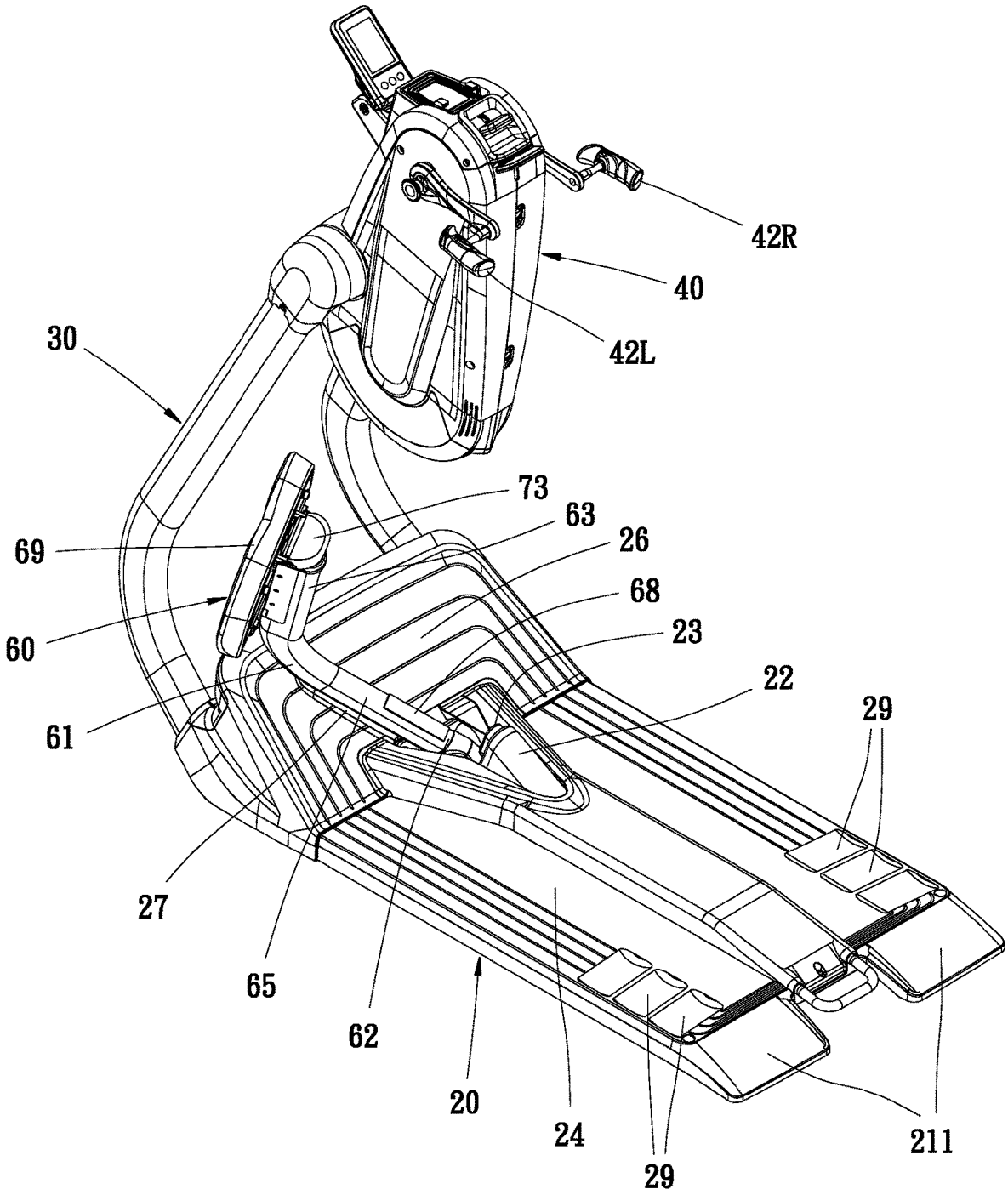
FIG. 15 is a perspective view of the upper body exercise apparatus of the preferred embodiment in another mode.
Figure 18:
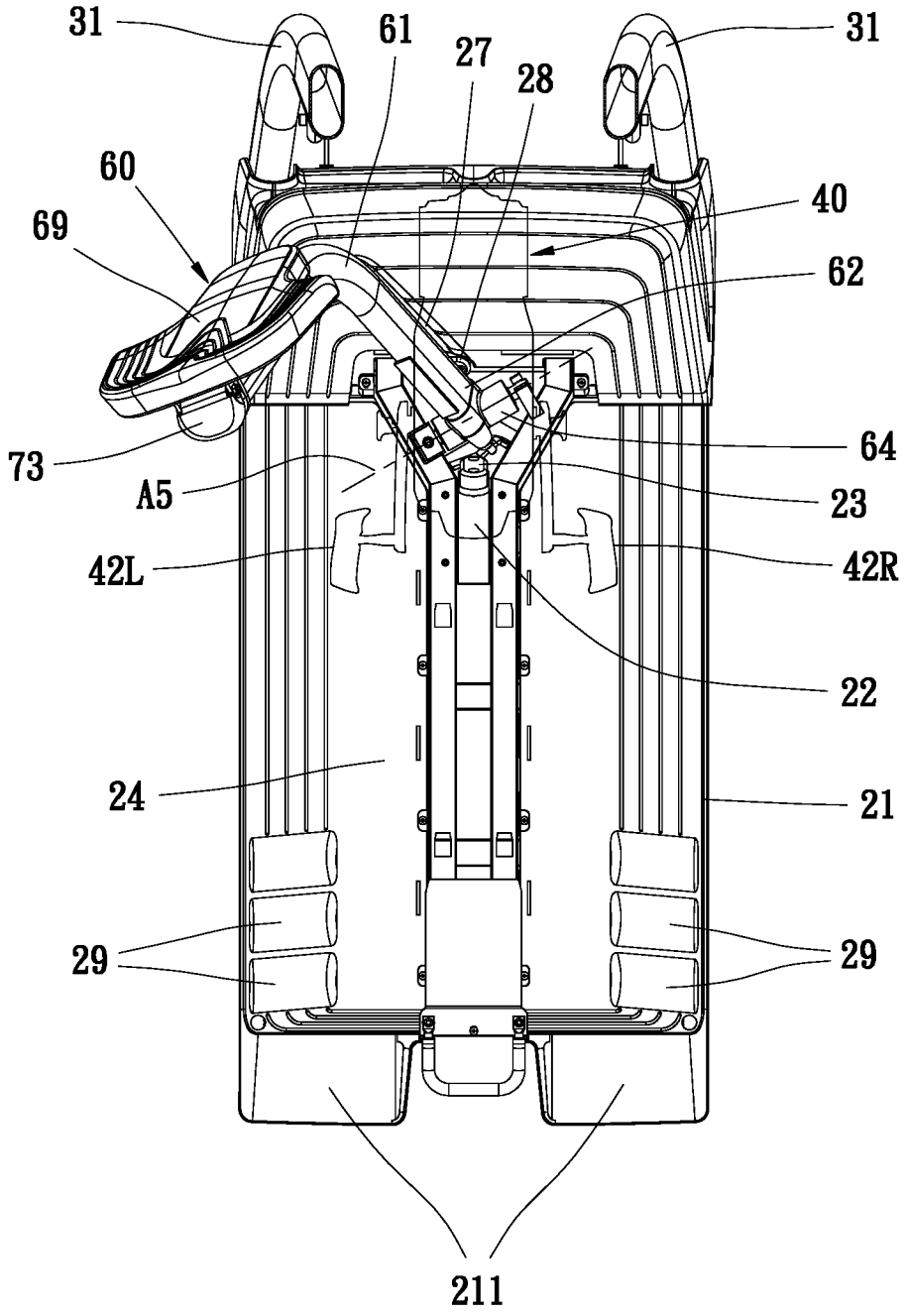
FIG. 18 is a top view of the physical exercise device shown in FIG. 15.

The movable seat 60 can be limitedly rotatable relative to the frame body about the pivot axis A5. Specifically, the movable seat 60 is pivotable about the pivot axis A5 between a use position (as shown in FIG. 1) and an idle position (as shown in FIG. 15). When the movable seat 60 is in the use position, the seat portion 69 is located above and behind the first end 62 of the seat post 61, as shown in a side view in FIG. 2; and located behind the left hand pedal 42L and the right hand pedal 42R of the physical exercise device 40, as shown in a top view in FIG. 13. When the movable seat 60 is in the idle position, the seat portion 69 is located above and in front of the first end 62 of the seat post 61, as shown in a side view in FIG. 16; and located at the left side of the physical exercise device 40, as shown in a top view in FIG. 18. Since the pivot axis A5 in the present embodiment is an axis extending from the rear left to the front right, when the movable seat 60 is turned from the use position to the front left to the idle position, the movable seat 60 is located on the left side of the physical exercise device 40. In another embodiment, the pivot axis A5 may be an axis extending from the rear right to the front left, so that when the movable seat 60 is turned from the use position to the front right to the idle position, the movable seat 60 is located on the right side of the physical exercise device 40.

The chassis 21 of the frame body 10 has a bump 22 disposed on the lateral center of the chassis 21. The bump 22 is mainly formed by a bump frame 22' which is welded by metal parts, as shown in FIG. 11. The bump 22 has a first rubber block 23 fixed on the front side of the bump frame 22' and located above and behind the first end 62 of the seat post 61. When the movable seat 60 is in the use position, the inclined section 65 of the seat post 61 extends rearward and upward from the first end 62, and the rear side (with a reinforcing plate 68) of the lower portion of the inclined section 65 abuts against the first rubber block 23. At this time, the straight section 67 of the seat post 61 extends horizontally from the front to the rear, as a cantilever supporting the seat portion 69 above and behind the first rubber block 23. In this manner, the first rubber block 23 forms an abutting portion for retaining the movable seat 60 at the use position, so that the movable seat 60 can no longer be turned backward, and the backward force applied by the movable seat 60 can be absorbed by the first rubber block 23.

The aforementioned incline platform 25 at the front end of the chassis 21 has an inclined plane 26 extending forward and upward from the chassis 21. As shown in FIG. 1 and FIG. 3, the inclined plane 26 has a shallow groove 27 extending forward from the center of the rear edge of the inclined plane 26 to the upper left of the inclined plane 26, and a second rubber block 28 is fixed on the rear end (or bottom end) of the shallow groove 27, such that the shallow groove 27 and the second rubber block 28 together form a resting portion. When the movable seat 60 is positioned in the idle position, the inclined section 65 of the seat post 61 extends forward to the upper left from the first end 62, and the front side of the inclined section 65 rests against the shallow groove 27 (especially the part close to the first end 62 will certainly abuts against the second rubber block 28), so that the movable seat 60 can no longer be turned forward. In the preferred embodiment, the flip angle between the movable seat 60 between the aforementioned use position and the idle position is less than 90 degrees.

When the movable seat 60 is in the use position, the center of gravity of the movable seat 60 is located above and behind the first end 62 (as a fulcrum), so that the movable seat 60 will not flip forward unless it is forced by a sufficient external force applied in a specific direction. Likewise, when the movable seat 60 is in the idle position, the center of gravity of the movable seat 60 is located in front of and above the first end 62, so that the movable seat 60 will not flip backward unless it is forced by a sufficient external force applied in a specific direction.

Figure 14:
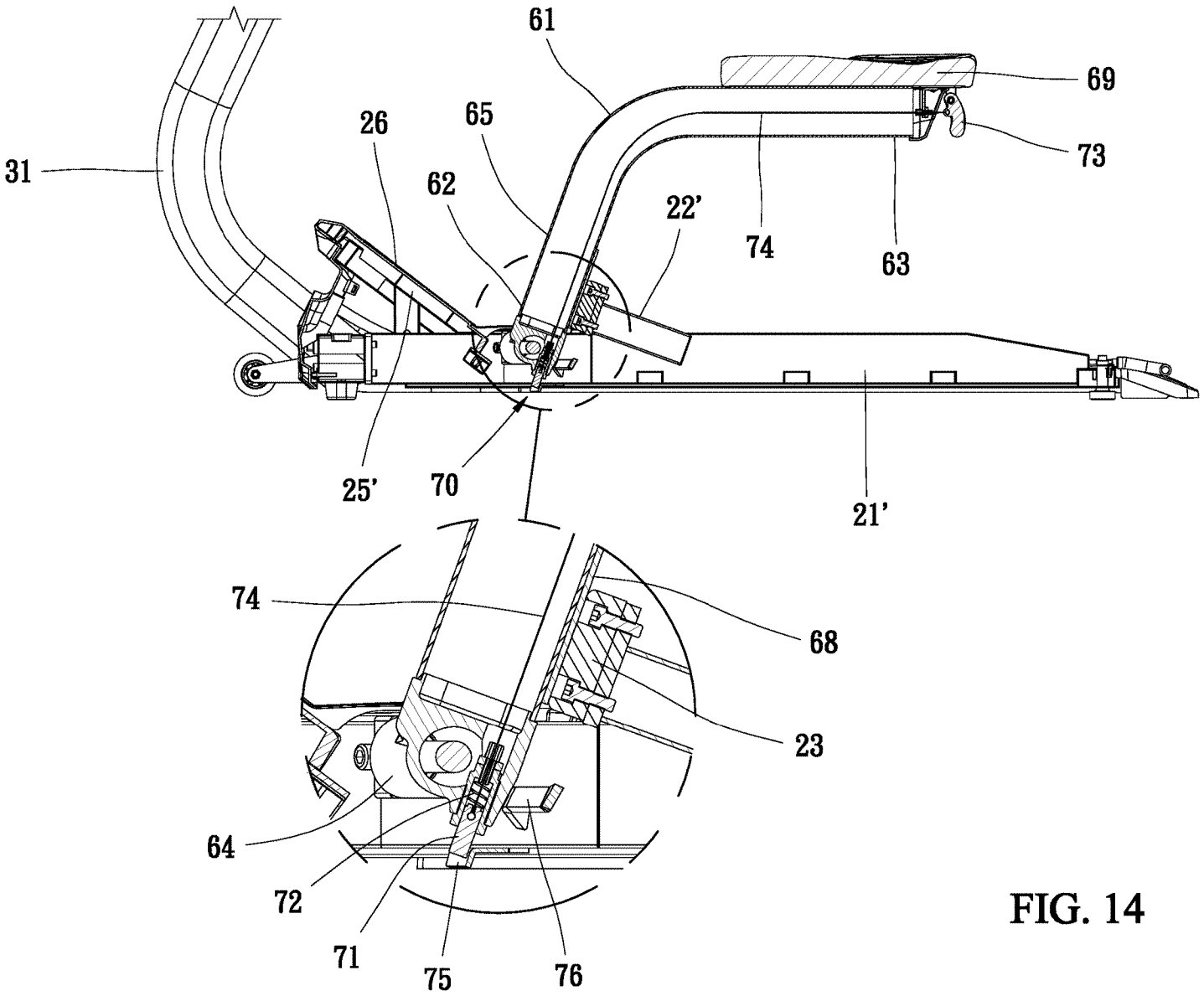
FIG. 14 is a cross-sectional view along line XIV-XIV of FIG. 13.

In order to further improve safety and stability, in the preferred embodiment, a locking mechanism 70 is arranged between the movable seat 60 and the base portion 20 of the frame body 10, as shown in FIG. 14. The locking mechanism 70 can be operated by the user to be changed between a locking state and a releasing state. When the locking mechanism 70 is in the locking state, the movable seat 60 can be locked in the use position to prevent the movable seat from rotating toward the idle position, or locked in the idle position to prevent the movable seat from rotating toward the use position. Specifically, as shown in FIG. 14, the locking mechanism 70 includes a lock bolt 71, a spring 72, a lever 73, a cable 74, a first retaining member 75 and a second retaining member 76. The lock bolt 71 is disposed at the first end 62 of the seat post 61 and movable with respect to the seat post 61 between a lock position and an unlock position. The spring 72 is mounted between the lock bolt 71 and the seat post 61 and configured to provide an elastic force to bias the lock bolt 71 toward the lock position. For example, as shown in FIG. 14, the extension force of the spring 72 pushes the lock bolt 71 downward, namely the tail end of the lock bolt 71 is protruded from the first end 62 of the seat post 61. The lever 73 is pivotally mounted near the second end 63 of the seat post 61, e.g. disposed at the rear end of the bottom of the seat portion 69. The cable 74 extends along the seat post 61 (hollow tube) and connects the lever 73 and the lock bolt 71, so that the lock bolt 71 can be pulled toward the unlock position through the cable 74 by operating the lever 73. For example, as shown in FIG. 14, the lock bolt 71 can be pulled by the lever 73 to make the tail end of the lock bolt 71 be retracted into the seat post 61. The first retaining member 75 and the second retaining member 76 are both metal parts, respectively welded to two predetermined positions of the chassis frame 21' close to the first end 62 of the seat post 61. When the movable seat 60 is in the use position and the lock bolt 71 is in the lock position, the tail end of the lock bolt 71 will be retained by the first retaining member 75, so that the movable seat 60 cannot be rotated toward the idle position. Similarly, when the movable seat 60 is in the idle position and the lock bolt 71 is in the lock position, the tail end of the lock bolt 71 will be retained by the second retaining member 76, so that the movable seat 60 cannot be rotated toward the use position.

Figure 17:
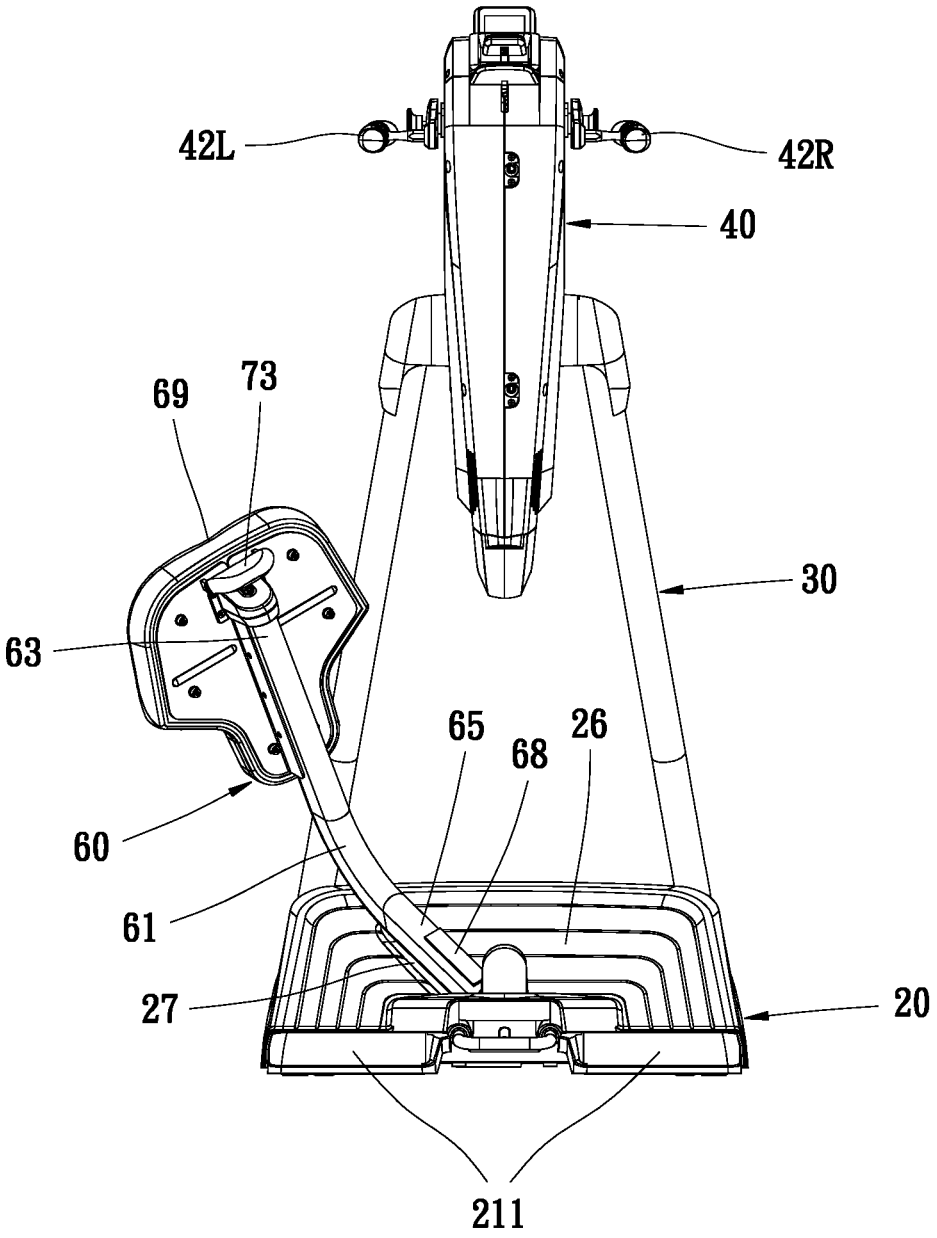
FIG. 17 is a rear view of the upper body exercise apparatus shown in FIG. 15.

Under this arrangement, the exercise apparatus of the present embodiment allows the user to choose to perform the aforementioned upper body exercise in a predetermined sitting or standing position. If the user wants to take a sitting posture to perform the upper body exercise, they can place the movable seat 60 in the aforementioned use position, sit on the seat portion 69 and face forward, and then adjust the physical exercise device 40 to a suitable position according to individual body shapes and habits. For example, the aforementioned sitting suitable position, the exercise apparatus presents a mode as shown in FIG. 1 to FIG. 3 (referred to as a first mode), such that the user can sit on the seat portion 69 to operate the two hand pedals 42L, 42R at an appropriate distance in front of the user's chest to perform the upper body exercise. During exercise, the user's legs are located on the left and right sides of the seat post 61, and their feet can step on the inclined plane 26 of the inclined platform 25. In contrast, if the user wants to take a standing posture to perform the upper body exercise, they have to place the movable seat 60 to the idle position to vacate the area occupied by the movable seat 60 first, and stand on the chassis 21 and face forward, and then adjust the physical exercise device 40 to a suitable position according to individual body shapes and habits. For example, the aforementioned standing suitable position, the exercise apparatus presents a mode as shown in FIG. 15 to FIG. 17 (referred to as a second mode), such that the user can stand on the chassis 21 to operate the two hand pedals 42L, 42R at an appropriate distance in front of the user's chest to perform the upper body exercise. The chassis 21 forms a standing area 24 behind the first end 62 of the seat post 61 for allowing the user who takes a standing posture to perform the upper body exercise to stand thereon with two feet. When the movable seat 60 is in the use position, the seat portion 69 is located above the standing area 24. That is, without removing the movable seat 60, the user cannot stand behind the two hand pedals 42L, 42R to perform the upper body exercise comfortably.

Figure 19:
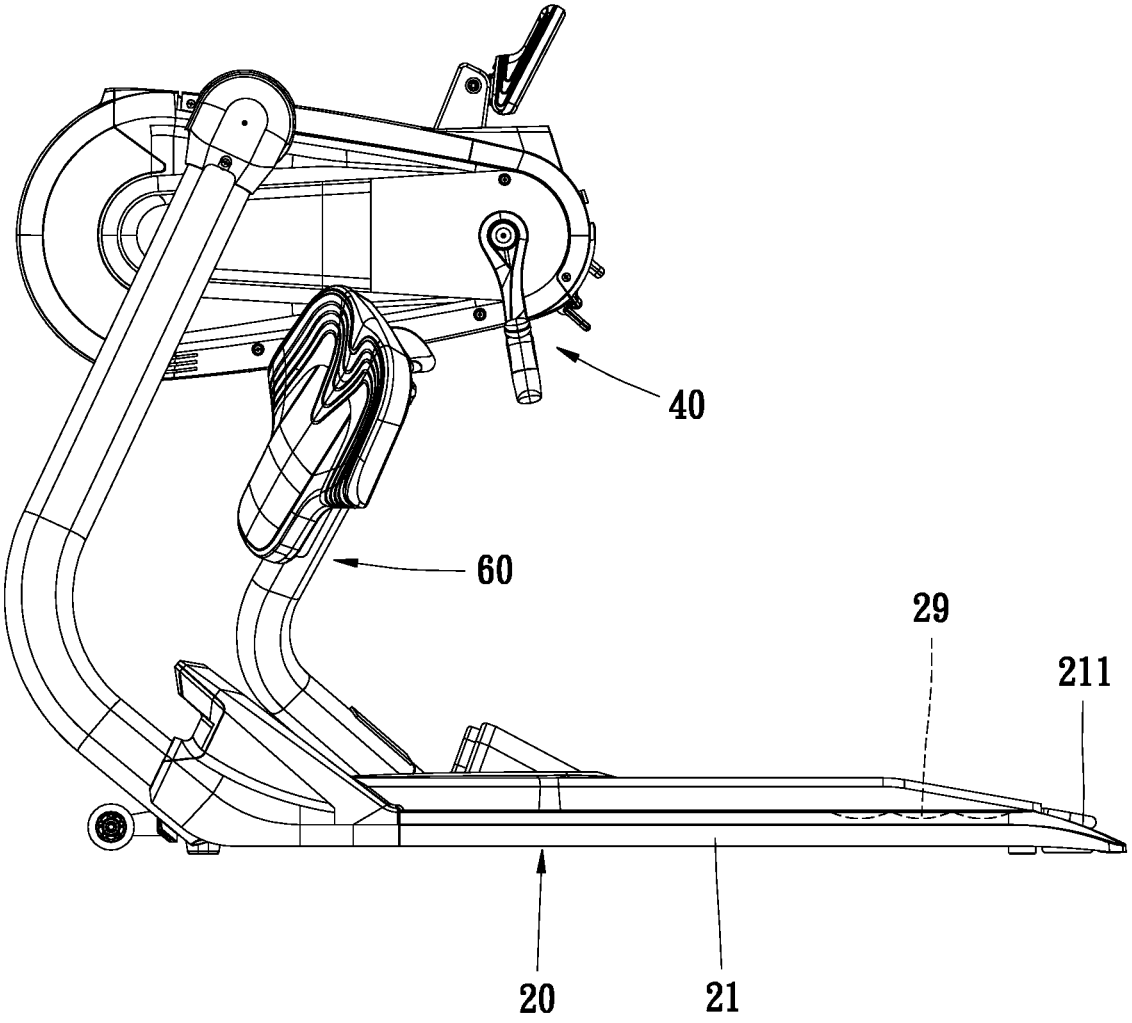
FIG. 19 is a side view of the upper body exercise apparatus in a mode suitable for wheelchair users.

The aforementioned exercise apparatus can also be provided for allowing users who are sitting in wheelchairs and inconvenient to stand up to perform the aforementioned upper body exercise. In operation, the movable seat 60 has to be placed in the idle position, and then the user can move their wheelchair from the rear side of the exercise apparatus to the chassis 21, and the bottoms of the two wheels will slightly sink into concavities 29 disposed at left and right sides of the chassis 21 so as to preventing the wheelchair from sliding back and forth, as shown in FIG. 15. If the wheelchair itself has brake devices, the wheelchair can be further locked. Then, the user can adjust the physical exercise device 40 to a suitable position, such as the sitting suitable position, as shown in FIG. 19. In the preferred embodiment, there are two or more concavities 29 respectively disposed at the left and right sides of the chassis 21 and arranged in a row, so that the position of the wheelchair can be adjusted forward and backward by positioning the wheels at different concavities 29. Therefore, the wheelchair user can sit on the wheelchair to operate the two hand pedals 42L, 42R at an appropriate distance in front of their chest to perform the upper body exercise. After the exercise, the user remains facing forward to back the wheelchair away from the chassis 21. The chassis 21 has two inclines 211 at the rear ends of the left and right sides of the chassis 21, which is convenient for wheelchairs to enter and exist. As described above, the exercise apparatus can be provided for wheelchair users to perform the upper body exercise. Since the movable seat 60 is in an idle state, it also belongs to the aforementioned second mode.

In another embodiment, the bottom of the frame body may not have a portion similar to the chassis, namely when the user performs the upper body exercise in the standing position, both feet are directly on the ground, and when the user in the wheelchair performs the upper body exercise, the wheels of the wheelchair are also on the ground rather than the chassis.

In the preferred embodiment, if the user wants to rotate the movable seat from the use position to the idle position, or rotate the movable seat 60 from the idle position to the use position, the use has to pull the lever 73 at the second end 63 of the seat post 61 to make the tail end of the lock bolt 71 at the first end 62 of the seat post 61 be retracted and not retained by the first retaining member 75 or the second retaining member 76, namely the locking mechanism 70 is changed from the locking state to the releasing state for allowing the movable seat 60 to be flipped. When the movable seat is in the use position, the seat portion 69 is facing upward and the straight section 67 of the seat post 61 is extending rearward under the bottom the seat portion 69, such that the lever 73 is correspondingly located at the rear end of the bottom of the seat portion 69 for allowing the user to reach their hands to pull the lever 73 and flip the movable seat conveniently. When the movable seat 60 is in the idle position, the seat portion 69 is generally facing forward and straight section 67 of the seat post 61 is extending upward at the rear side of the seat portion 69.

Before rotating or turning over the movable seat 60, the user may need to raise the rear end of the physical exercise device 40 above a certain height, depending on the situation, so as to avoid collision between the movable seat 60 and the physical exercise device 40 (especially the left hand pedal 42L) during the turning period. For example, when the physical exercise device 40 is located in the standing suitable position, the movable seat 60 can be freely turned between the use positon and the idle position without interfering with the physical exercise device 40. As shown in FIG. 16, when the physical exercise device 40 is located in the standing suitable position and the movable seat 60 is in the idle position, the highest part of the movable seat 60 is higher than the lowest part of the physical exercise device 40. In another embodiment, the physical exercise device for the upper body exercise may be fixed at a predetermined height which is suitable for allowing the user to operate no matter sitting or standing. In addition, the movable seat 60 can also be designed such that the seat height can be adjustable. In another embodiment, the physical exercise device may be provided for allowing the user to perform lower body exercise or perform the upper body exercise and the lower body exercise simultaneously.

Under this arrangement, the exercise apparatus can be changed between the first mode and the second mode according to requirement of the user. The user can simply move the movable seat 60 between the use position and the idle position for changing the usage mode of the exercise apparatus easily and quickly.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An exercise apparatus provided for allowing a user to perform a physical exercise, which defining a longitudinal direction, a lateral direction and a vertical direction, comprising:

a frame body having a base portion;

a physical exercise device mounted on the frame body, having at least one moving member for allowing the user to perform the physical exercise with hands or legs; and a movable seat having a seat post and a seat portion, the seat post having a first end and the second end, the second end being located higher than the first end, the first end of the seat post pivotally mounted on the base portion of the frame body about a pivot axis, the seat portion mounted on the second end of the seat post, the movable seat being pivotable about the pivot axis between a use position and an idle position;

wherein when the movable seat is in the use position, the seat portion is located above and behind the first end of the seat post and located behind the moving member; when the movable seat is in the idle position, the seat portion is located above and in front of the first end of the seat post and located at a left side or right side of the physical exercise device.

2. The exercise apparatus as claimed in claim 1, wherein the pivot axis is located in a horizontal plane, and an included angle between the pivot axis and the lateral direction ranges between 15 degrees to 75 degrees.

3. The exercise apparatus as claimed in claim 1, wherein the movable seat is rotatable between the use position and the idle position, and a rotation angle between the use position and the idle position is less than 90 degrees.

4. The exercise apparatus as claimed in claim 1, wherein the base portion of the frame body has an abutting portion located above and behind the first end of the seat post; the seat post has an inclined section adjacent to the first end; and wherein when the movable seat is in the use position, the inclined section of the seat post extends rearward and upward from the first end, and a rear side of the inclined section abuts against the abutting portion.

5. The exercise apparatus as claimed in claim 4, wherein the base portion of the frame body has a resting portion diagonally in front of and located above the first end; when the movable seat is in the idle position, the inclined section of the seat post extends obliquely forward and upward from the first end, and a front side of the inclined section abuts against the resting portion.

6. The exercise apparatus as claimed in claim 1, further comprising a locking mechanism arranged between the movable seat and the base portion of the frame body, the locking mechanism being operable to be changed between a locking state and a releasing state, when the locking mechanism is in the locking state, the movable seat can be locked in the use position to prevent the movable seat from rotating toward the idle position, or locked in the idle position to prevent the movable seat from rotating toward the use position.

7. The exercise apparatus as claimed in claim 6, wherein the locking mechanism has a lock bolt, a spring, a lever and a cable; the lock bolt is disposed at the first end of the seat post and being movable with respect to the seat post between a lock position and an unlock position; the spring is mounted between the lock bolt and the seat post and configured to provide an elastic force to bias the lock bolt toward the lock position; the lever is disposed at the second end of the seat post; the cable extends along the seat post and connects the lever and the lock bolt, so that the lock bolt can be pulled toward the unlock position through the cable by operating the lever.

8. The exercise apparatus as claimed in claim 7, wherein the locking mechanism has a first retaining member and a second retaining member respectively disposed at two predetermined positions at the base portion of the frame body close to the first end of the seat post; wherein when the movable seat is in the use position and the lock bolt is in the lock position, the lock bolt is retained by the first retaining member so that the movable seat cannot be rotated toward the idle position; and wherein when the movable seat is in the idle position and the lock bolt is in the lock position, the lock bolt is retained by the second retaining member so that the movable seat cannot be rotated toward the use position.

9. The exercise apparatus as claimed in claim 1, wherein the moving member of the physical exercise device is provided for being operated by the user's hands; the physical exercise device is adjustable with respect to the frame body between a first position which is suitable for being operated in a sitting position and a second position which is suitable for being operated in a standing position; wherein a height of the moving member when the physical exercise device is located at the second position is higher than a height of the moving member when the physical exercise device is located at the first position; and wherein the movable seat is rotatable freely between the use position and the idle position at least when the physical exercise device is located in the second position which is suitable for being operated in the standing position.

10. The exercise apparatus as claimed in claim 9, wherein when the physical exercise device is in the second position and the movable seat is in the idle position, an uppermost portion of the movable seat is located higher than a lowermost portion of the physical exercise device.

11. The exercise apparatus as claimed in claim 9, wherein the base portion of the frame body forms a standing area behind the first end of the seat post for allowing the user who takes a standing position to perform the physical exercise to stand thereon with two feet; and wherein when the movable seat is in the use position, the seat portion is located above the standing area.

* * * * *